US009610774B2

(12) United States Patent
Hasegawa

(10) Patent No.: US 9,610,774 B2
(45) Date of Patent: Apr. 4, 2017

(54) LIQUID DISCHARGE APPARATUS

(71) Applicant: Brother Kogyo Kabushiki Kaisha, Nagoya-shi, Aichi-ken (JP)

(72) Inventor: Shin Hasegawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/757,549

(22) Filed: Dec. 24, 2015

(65) Prior Publication Data

US 2016/0185105 A1 Jun. 30, 2016

(30) Foreign Application Priority Data

Dec. 26, 2014 (JP) ..... 2014-265266

(51) Int. Cl.
*B41J 2/165* (2006.01)
*B41J 2/045* (2006.01)

(52) U.S. Cl.
CPC ..... *B41J 2/16579* (2013.01); *B41J 2/0451* (2013.01); *B41J 2/0456* (2013.01); *B41J 2/04561* (2013.01); *B41J 2/04581* (2013.01); *B41J 2/04596* (2013.01); *B41J 2/16517* (2013.01); *B41J 2002/1657* (2013.01); *B41J 2002/16573* (2013.01)

(58) Field of Classification Search
CPC ..... B41J 2/16579
See application file for complete search history.

(56) References Cited

U.S. PATENT DOCUMENTS

2006/0007260 A1* 1/2006 Oku ..... B41J 29/393 347/19
2015/0062226 A1* 3/2015 Otokita ..... B41J 2/0451 347/14
2015/0191017 A1* 7/2015 Matsumoto ..... B41J 2/165 347/22

FOREIGN PATENT DOCUMENTS

JP S63-197656 A 8/1988
JP 2003-276184 A 9/2003
JP 2005-178290 A 7/2005
JP 2006170756 A * 6/2006
JP 2010142676 A * 7/2010

* cited by examiner

*Primary Examiner* — Shelby Fidler
(74) *Attorney, Agent, or Firm* — Banner & Witcoff, Ltd.

(57) ABSTRACT

There is provided a liquid discharge apparatus including: a liquid discharge head which includes a channel structure provided with a nozzle and a liquid channel, a driving element, and a driving unit; a light emitting part; a liquid receiving part receiving light passed through or reflected by the meniscus; and a controller. The controller controls the driving unit to apply at least one of several kinds of meniscus driving signals to the driving element in a state that the light emitting part emits the light to the nozzle, thereby vibrating the meniscus in the nozzle, and is configured to determine a recovery operation from among several kinds of recovery operations which have mutually different liquid discharge amounts to be discharged from the nozzle, on the basis of an amount of light which is received by the light receiving part in the case of vibrating the meniscus of the liquid.

16 Claims, 18 Drawing Sheets

(JUDGING PROCESS OF DISCHARGE FAILURE)

(DETERMINING PROCESS)

(PRINTING PROCESS)

LIQUID DISCHARGE APPARATUS

CROSS REFERENCE TO RELATED APPLICATION

The present application claims priority from Japanese Patent Application No. 2014-265266 filed on Dec. 26, 2014, the disclosure of which is incorporated herein by reference in its entirety.

BACKGROUND

Field of the Invention

The present invention relates to a liquid discharge apparatus configured to discharge liquid.

Description of the Related Art

Liquid discharge apparatuses discharging liquid from nozzles have discharge failure in some cases. The causes of the discharge failure include, for example, the increase in viscosity of liquid in the nozzle which results from dryness (hereinafter referred to as "thickening of liquid") and mixing of bubbles in a liquid channel. The discharge failure causes such a situation that the liquid is not normally discharged from the nozzle. There have been conventionally known various technologies for inspecting discharge failure of the nozzle, such as the technology for inspecting discharge failure without discharge of liquid from the nozzle.

The typical liquid discharge apparatuses include a printing head of an ink-jet recording apparatus. For example, there is known a printing head including: a nozzle plate in which nozzles are formed; a waveguide formed in the nozzle plate to extend in a nozzle row direction; a light source introducing light into the waveguide; and a light receiving part detecting an amount of light travelling through the waveguide. In the case of inspecting the discharge failure of the nozzle, pressure change is given to liquid in the nozzle to an extent that no liquid is discharged. Specifically, pressure change is given to the liquid in a state that light is introduced from the light source along the waveguide, thereby vibrating the meniscus of liquid in the nozzle.

The vibration of meniscus in the nozzle having no discharge failure is different from the vibration of meniscus in the nozzle having discharge failure. When the meniscus in the nozzle having no discharge failure vibrates, the meniscus is greatly drawn into the nozzle. Thus, the light introduced into the waveguide travels therethrough with little leakage from the nozzle and is received by the light receiving part. On the other hand, when the meniscus in the nozzle having discharge failure vibrates, the meniscus is hardly drawn into the nozzle. Thus, a part of the light introduced into the waveguide leaks in the nozzle, thereby reducing an amount of light received by the light receiving part. Namely, whether or not the nozzle has discharge failure can be determined on the basis of the amount of light received by the light receiving part.

Further, the typical liquid discharge apparatuses perform a predetermined recovery operation for the nozzle having discharge failure. The recovery operation is performed to recover the discharge performance of the nozzle having the discharge failure. The recovery operation may be meniscus vibration, preliminary discharge (flushing), suction cleaning (suction purge), and the like.

SUMMARY

In addition to the thickening of liquid and the mixing of bubbles in the nozzle, various factors including, for example, mixing of foreign substances into a liquid channel including the nozzle and deterioration of an actuator element may cause the discharge failure of the nozzle. According to the knowledge of the inventor of the present teaching, the recovery operation suitable for eliminating the discharge failure differs according to the factor or cause of the discharge failure.

For example, when the discharge failure is caused by the thickening of liquid which has not proceeded so much, simply vibrating the meniscus in the nozzle without discharging liquid agitates the liquid in the nozzle, thereby making it possible to eliminate the thickening of liquid. Further, even when the thickening of liquid has proceeded to some degree, the thickening of liquid can be eliminated by the flushing in which a relatively small amount of liquid is discharged from the nozzle. Thus, if the purge discharging a large amount of liquid is performed to eliminate such a discharge failure, it is a waste of liquid and thus uneconomical. On the other hand, when the discharge failure is caused by mixing of bubbles and/or foreign substances in the liquid channel, the purge is effective. In the purge, a large amount of liquid is discharged from nozzles in a short time so as to discharge mixed bubbles and foreign substances together with the liquid. Since the meniscus vibration and flushing are not likely to eliminate the discharge failure caused by mixing of bubbles and/or foreign substances, performing these less effective operations results in a waste of time. Further, the flushing results in a waste of liquid.

As described above, those skilled in the art know that any recovery operation is performed when the nozzle has discharge failure. The recovery operation can be exemplified, for example, the following three: meniscus vibration, preliminary discharge, and suction cleaning. However, the inventor of the present teaching believes that performing each of the three recovery operations according to the cause of discharge failure is not known by those skilled in the art.

An object of the present teaching is to effectively eliminate the discharge failure of a nozzle which has been detected by meniscus vibration, by performing a recovery operation suitable for the cause of the discharge failure.

According to an aspect of the present teaching, there is provided a liquid discharge apparatus configured to discharge liquid to a medium, including:

- a liquid discharge head including a channel structure, a driving element, and a driving unit,
  - the channel structure including a nozzle and a liquid channel communicating with the nozzle,
  - the driving element provided in the channel structure and configured to supply, to the liquid, discharge energy for discharging the liquid from the nozzle,
  - the driving unit configured to apply a discharge driving signal and several kinds of meniscus driving signals to the driving element, the discharge driving signal being applied to discharge the liquid from the nozzle corresponding to the driving element, the meniscus driving signals having mutually different waveforms and being applied to vibrate meniscus of the liquid in a discharge port of the nozzle corresponding to the driving element,
- a light emitting part configured to emit light to the nozzle of the liquid discharge head;
- a light receiving part configured to receive light which has passed through the meniscus of the nozzle or reflected by the meniscus; and
- a controller configured to:
  - control the driving unit to apply at least one of the meniscus driving signals to the driving element in a state that the light emitting part emits the light to the nozzle corresponding to the driving element, thereby vibrating the meniscus of the liquid in the discharge port of the nozzle; and determine an operation from among no recovery operation and several kinds of recovery operations which have mutually different liquid discharge amounts to be discharged from the nozzle, on the basis of an amount of light which is received by the light receiving part in the case of vibrating the meniscus of the liquid.

In the present teaching, the driving unit applies, to the driving element, not only the discharge driving signal for discharging the liquid form the nozzle but also several kinds of meniscus driving signals for vibrating the meniscus of liquid in the discharge port. In the case of inspection of discharge failure of the nozzle, the light emitting part at first emits light to the nozzle. Under this situation, the driving unit applies one of the meniscus driving signals to the driving element to vibrate the meniscus in the nozzle corresponding to the driving element. If the nozzle has discharge failure, the meniscus vibrates differently from the nozzle having no discharge failure. This results in the differences in the travelling direction of light passing through the meniscus, the travelling direction of light reflected by the meniscus, and the light amount received by the light receiving part between the nozzle having discharge failure and the nozzle having no discharge failure. Namely, the amount of light, which has passed through the meniscus of the nozzle having no discharge failure and received by the light receiving amount, is different from the amount of light which has passed through the meniscus of the nozzle having discharge failure and received by the light receiving part. On the basis of the difference in the light receiving amounts, whether or not each nozzle has discharge failure can be detected. Note that present teaching is applicable to not only a liquid discharge head including a single channel structure, a single driving element and a single nozzle, but also a liquid discharge head including a plurality of channel structures, a plurality of driving elements and a plurality of nozzles.

In the present teaching, the driving unit applies at least one meniscus driving signal, of the meniscus driving signals, to the driving element. When a nozzle has discharge failure due to a certain cause, the driving unit may apply a meniscus driving signal, of the meniscus driving signals, which corresponds to the cause of the discharge failure. In this case, the meniscus vibrates greatly and the light receiving amount received by the light receiving part changes greatly. Thus, the cause of the discharge failure can be determined on the basis of the meniscus driving signal used and the change in the light receiving amount, and thereby making it possible to perform the recovery operation suitable for the cause of the discharge failure.

DESCRIPTION OF THE EMBODIMENTS

Figure 1:
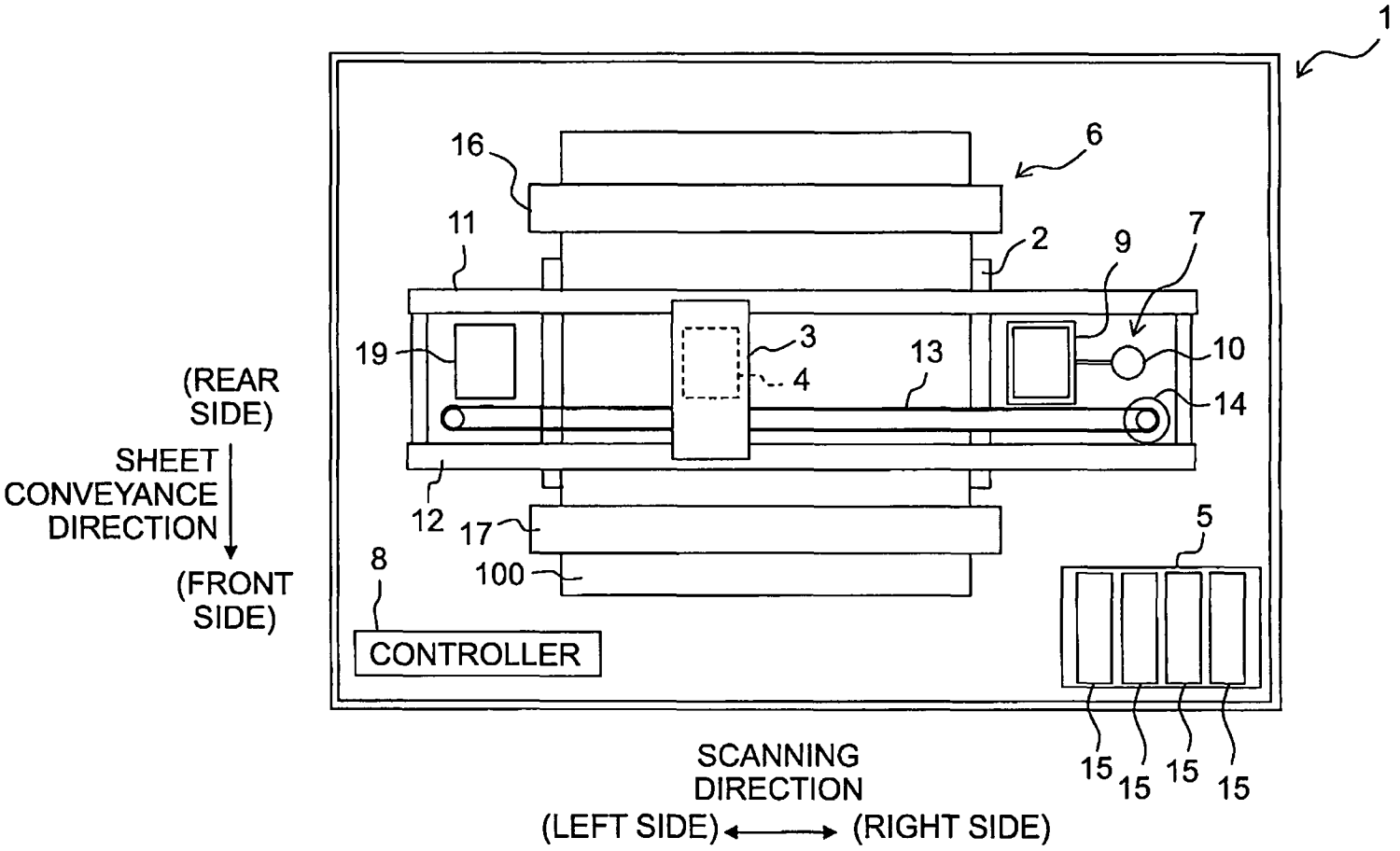
FIG. 1 is a schematic top view of a printer 1 according to an embodiment of the present teaching.

Subsequently, an explanation will be made about an embodiment of the present teaching. A scanning direction indicated in FIG. 1 is defined as a left-right direction of a printer 1. The upstream side in a sheet conveyance direction in FIG. 1 is defined as the rear side of the printer 1 and the downstream side in the sheet conveyance direction is defined as the front side of the printer 1. A direction perpendicular to the scanning direction and the sheet conveyance direction (direction perpendicular to the paper surface of FIG. 1) is defined as an up-down direction of the printer 1. Noted that the upper paper surface of FIG. 1 (the surface on which FIG. 1 is depicted) is defined as the upper side of the printer 1 and the back surface of FIG. 1 is defined as the lower side of the printer 1.

<Schematic Configuration of Printer>

Figure 2:
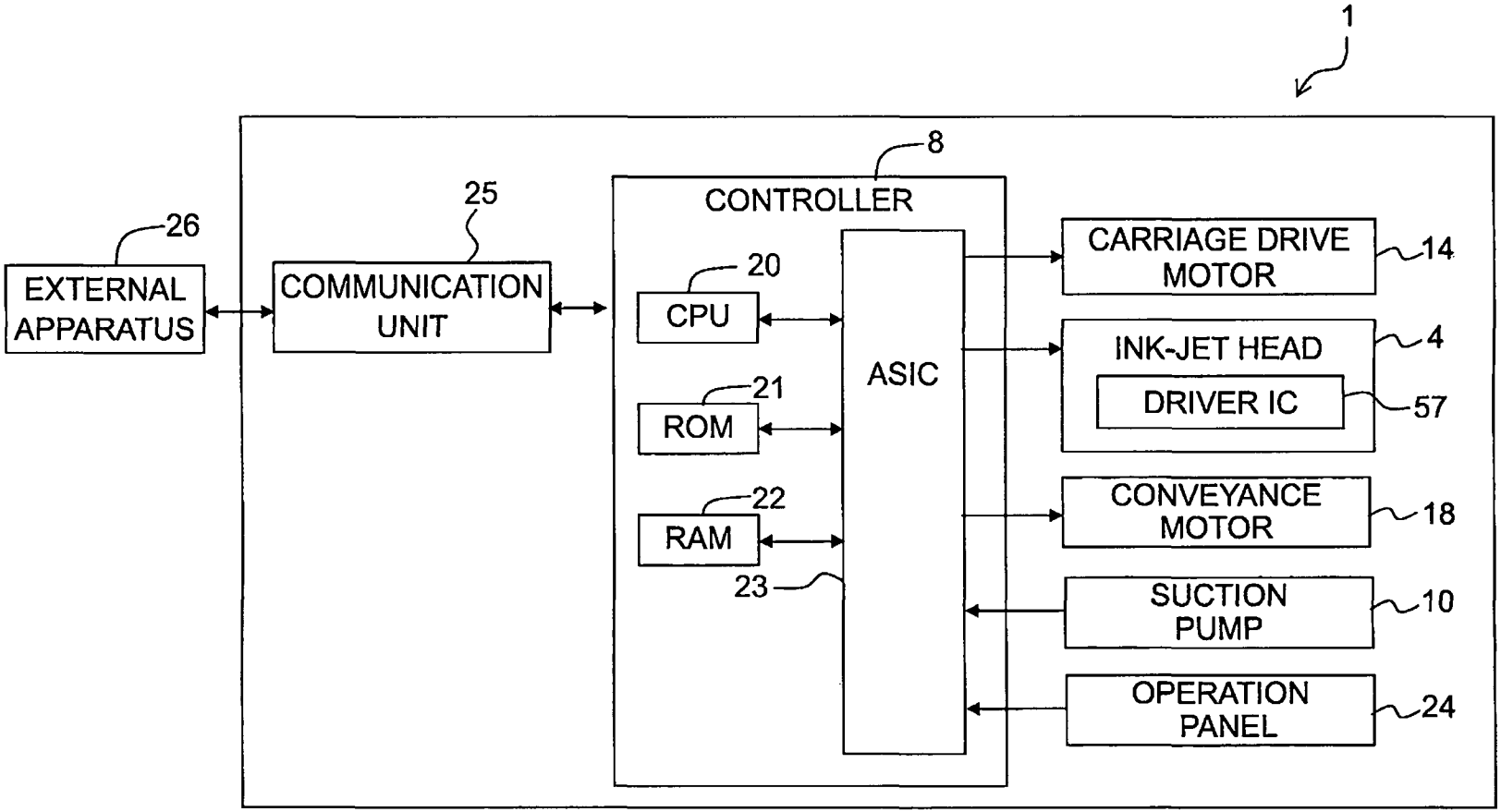
FIG. 2 is a block diagram schematically depicting an electrical configuration of the printer 1.

As depicted in FIGS. 1 and 2, the ink-jet printer 1 includes a platen 2, a carriage 3, an ink-jet head 4, a cartridge holder 5, a conveyance mechanism 6, a maintenance unit 7, a controller 8, and the like.

A recording sheet 100 as a recording medium is placed on the upper surface of the platen 2. The carriage 3 is configured to reciprocate within an area facing the platen 2 along two guide rails 11, 12 in the left-right direction (scanning direction). An endless belt 13 is connected to the carriage 3. Driving the endless belt 13 by a carriage drive motor 14 moves the carriage 3 in the scanning direction.

The ink-jet head 4, which is carried on the carriage 3, is movable together with the carriage 3 in the scanning direction. The ink-jet head 4 includes nozzles 44 (see FIGS. 2 to 5) in its lower surface (on the side of the back surface of FIG. 1).

Four ink cartridges 15, the colors of which are black, yellow, cyan, and magenta, are removably installed or mounted to the cartridge holder 5. The cartridge holder 5 is connected to the ink-jet head 4 via unillustrated tubes. Four colors of inks stored in the four ink cartridges 15 of the cartridge holder 5 are supplied to the ink-jet head 4 via the tubes respectively. The ink-jet head 4 discharges each of the inks from the nozzles 44 formed in the lower surface to the recording sheet 100 placed on the platen 2 while moving in the scanning direction. The configuration of the ink-jet head 4 will be explained later.

The conveyance mechanism 6 includes two conveyance rollers 16, 17 disposed to interpose the platen 2 therebetween in a front-rear direction. The two conveyance rollers 16, 17 are driven in synchronization with each other by means of a conveyance motor 18 depicted in FIG. 2. The conveyance mechanism 6 conveys the recording sheet 100 placed on the platen 2 forward (in the sheet conveyance direction) by use of the two conveyance rollers 16, 17.

The maintenance unit 7 is disposed on the right side of the platen 2. The maintenance unit 7 includes a cap 9 and a suction pump 10 connected to the cap 9. The cap 9 is driven in the up-down direction by an unillustrated cap lifting mechanism. When the cap 9 moves upward in a state of facing the ink-jet head 4, the cap 9 is brought in tight contact with the lower surface of the ink-jet head 4 to cover the nozzles 44. In this situation, when the suction pump 10 is driven to reduce the pressure in the cap 9, the ink is forcibly discharged from each of the nozzles 44 covered with the cap 9. This operation in which the ink is forcibly discharged from each of the nozzles 44 is to be referred to as "purge", and the purge is different from an ink discharge operation in which the ink is discharged from each of the nozzles 44 during normal printing operation. The purge can discharge bubbles and foreign substances, such as dust, mixed into the ink channel(s) including the nozzle(s) 44 of the ink-jet head 4, thereby making it possible to recover the discharge performance of the nozzle(s) 44 having discharge failure.

A receiving member for flushing 19 is disposed on the left side of the platen 2, namely, on the opposite side of the maintenance unit 7 with the platen 2 interposed therebetween. The receiving member 19 includes an absorber which can absorb each ink. In order to prevent the ink in each nozzle 44 from thickening, the ink-jet head 4 discharges the ink from the nozzles 44 in a state of facing the receiving member 19, at appropriate timing such as before printing on the recording sheet 100 or during printing on the recording sheet 100. The ink discharge operation in which each ink is discharged to the receiving member 19 is called "flushing". The ink discharged from each nozzle 44 during the flushing is absorbed into the absorber of the receiving member 19.

As depicted in FIG. 2, the controller 8 includes a Central Processing Unit 20 (CPU 20), a Read Only Memory 21 (ROM 21), a Random Access Memory 22 (RAM 22), an Application Specific Integrated Circuit 23 (ASIC 23) including various control circuits, and the like. The controller 8 is electrically connected to the ink-jet head 4, various motors such as the carriage drive motor 14 and the conveyance motor 18, the suction pump 10 of the maintenance unit 7, an operation panel 24, and the like. Further, the controller 8 is electrically connected to an external apparatus 26 such as a personal computer via a communication unit 25, and image data to be printed is inputted from the external apparatus 26. The controller 8 controls the CPU 20 to perform programs stored in the ROM 21, so that the ASIC 23 performs various processes such as the printing on the recording sheet 100.

<Configuration of Ink-Jet Head>

Figure 3:
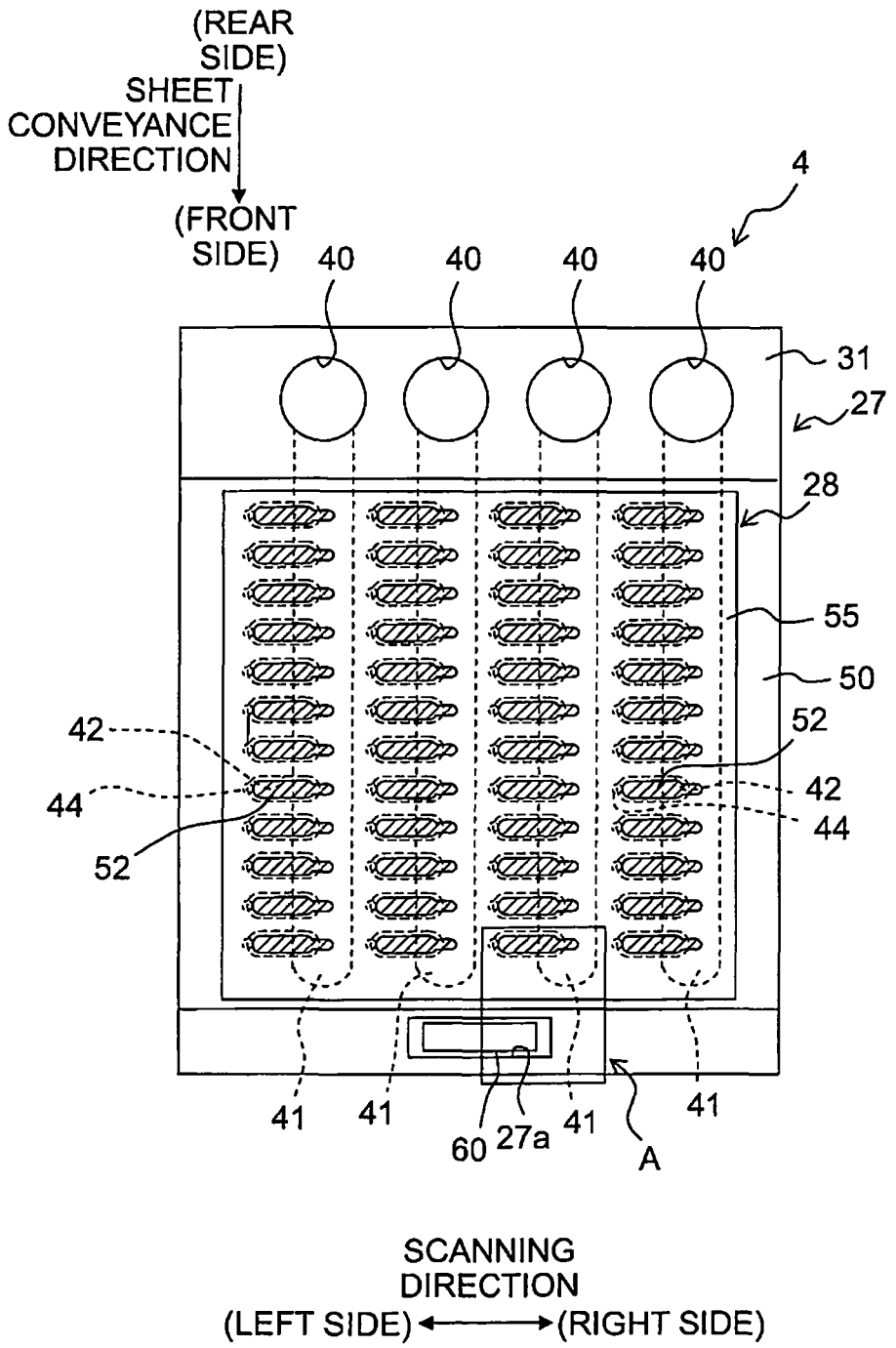
FIG. 3 is a top view of an ink-jet head 4.
Figure 4:
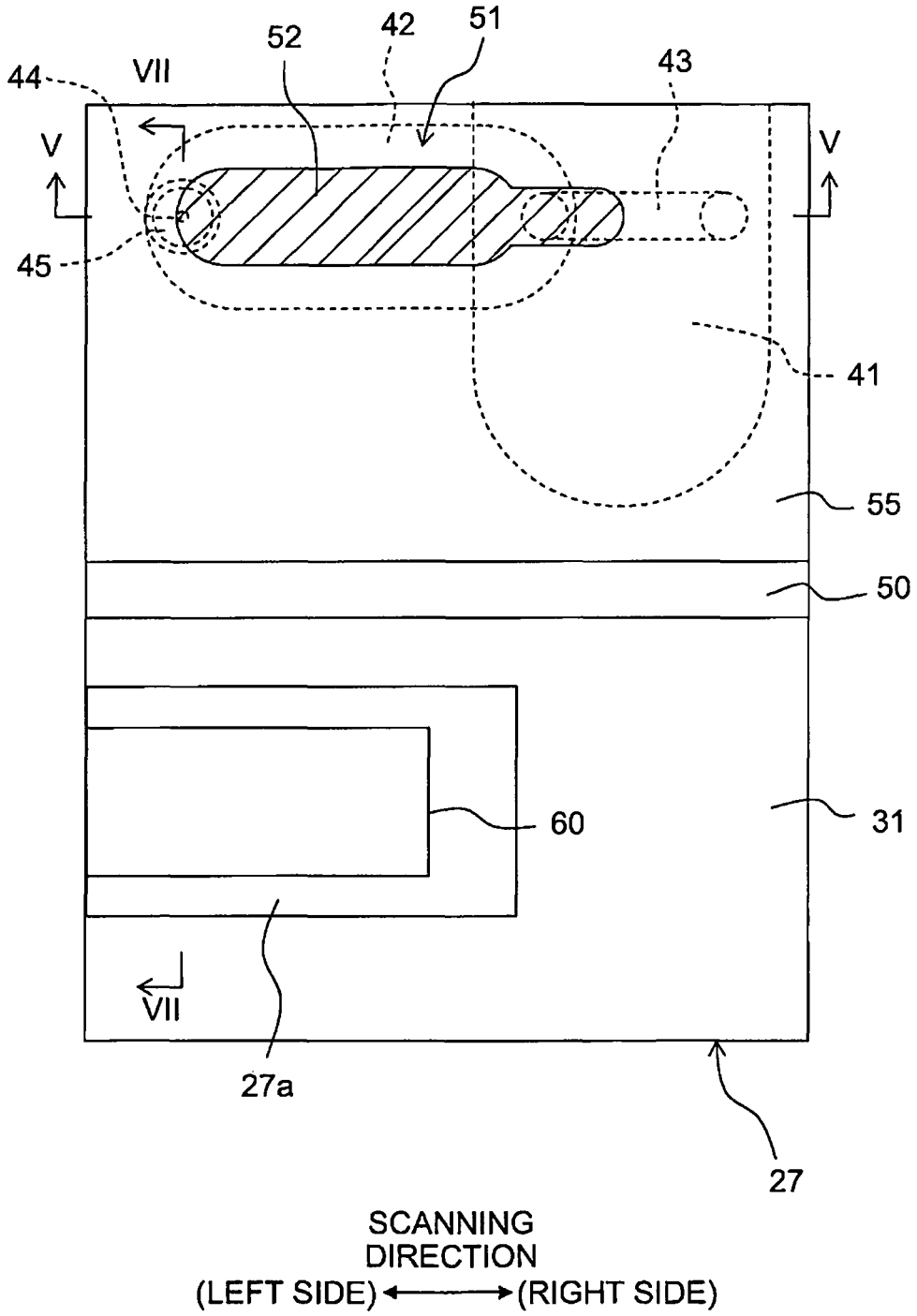
FIG. 4 is an enlarged view of the portion A in FIG. 3.
Figure 5:
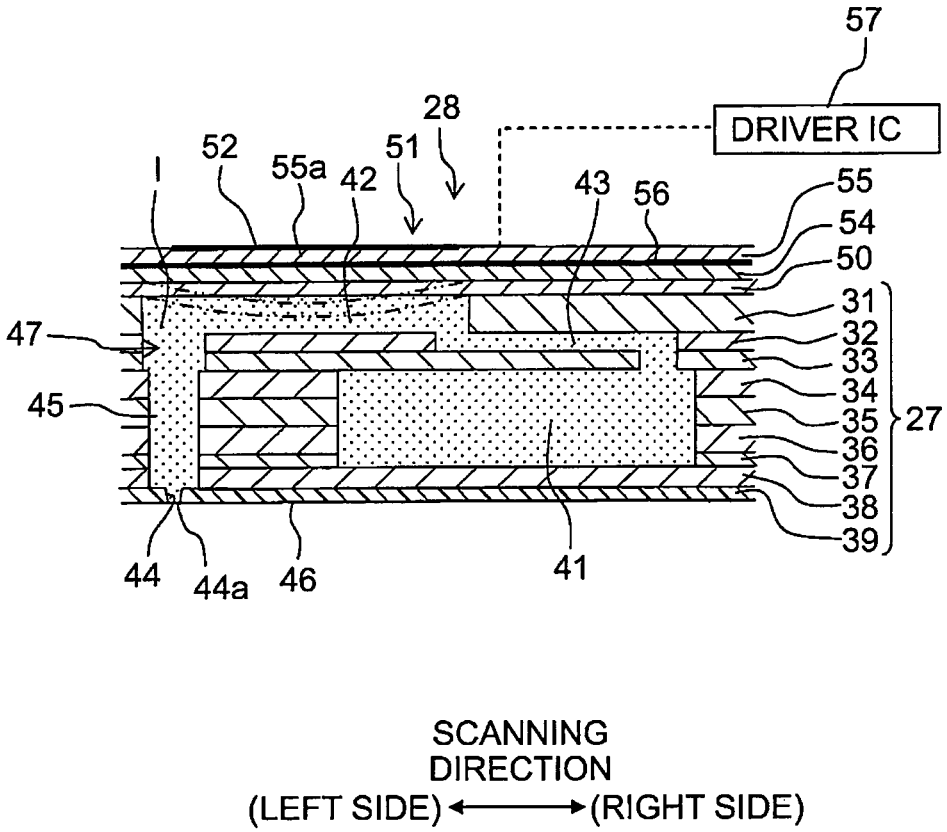
FIG. 5 is a cross-sectional view taken along the line V-V in FIG. 4.

Subsequently, the ink-jet head 4 will be explained in detail. As depicted in FIGS. 3 to 5, the ink-jet head 4 includes a channel unit 27 and a piezoelectric actuator 28. The hatched area in FIG. 5 depicts a state in which the ink (indicated by a reference numeral "I") is filled with the ink channels formed in the channel unit 27.

The channel unit 27 will be explained first. As depicted in FIG. 5, the channel unit 27 is formed of plates 31 to 39 stacked on top of each other. The stacked plates 31 to 39 are joined to each other by use of adhesive. The lowermost plate 39 of the plates 31 to 39 is a nozzle plate made of a translucent synthetic resin such as polyimide. The lowermost plate 39 includes the nozzles 44 each of which has a tapered form to penetrate the plate 39 in its thickness direction. As depicted in FIG. 3, the nozzles 44 form four nozzle rows each extending in the sheet conveyance direction. The four nozzle rows are disposed parallely to each other in the scanning direction. Four colors of inks (black, yellow, cyan, and magenta) are discharged from the four nozzle rows, respectively. Further, the nozzle plate 39 includes an ink-repellent film 46, which is made of a resin material such as fluororesin, on its lower surface where discharge ports 44*a* of the nozzles 44 are formed. Although the nozzle plate 39 is made of the translucent material, the ink-repellent film 46 is made of a light-shielding resin material.

The plates 31 to 38, of the plates 31 to 39 forming the channel unit 27, are made of a metallic material such as stainless steel. The plates 31 to 38 include the ink channels, which are formed, for example, of manifolds 41 and pressure chambers 42 as described later to communicate with the nozzles 44. The ink channels formed in the plates 31 to 38 will be explained below.

As depicted in FIG. 3, the uppermost plate 31 of the plates 31 to 38 of the channel unit 27 includes four ink supply holes 40 aligning in the scanning direction. Four colors of inks (black, yellow, cyan, and magenta) are supplied from four ink cartridges 15 (see FIG. 1) of the cartridge holder 5 to four ink supply holes 40, respectively. As depicted in FIG. 5, the fourth to seventh plates 34 to 37 from the uppermost plate 31 include four manifolds 41 extending in the sheet conveyance direction. Each of the manifolds 41 penetrates the four plates 34 to 37 stacked in the up-down direction. The four ink supply holes 40 are connected to the four manifolds 41 through communication holes (not depicted) formed in the plates 32, 33.

The plate 31 of the channel unit 27 includes pressure chambers 42 corresponding to the nozzles 44 respectively. The pressure chambers 42 are disposed to form four rows so as to correspond to the four manifolds 41. The pressure chambers 42 are covered with a vibration film 50 joined to the upper surface of the plate 31. As depicted in FIGS. 3 to 5, each pressure chamber 42 has a shape elongated in the scanning direction. Further, each pressure chamber 42 is disposed so that the left end thereof overlaps with the nozzle 44 and the right end thereof overlaps with the manifold 41, as viewed from above.

As depicted in FIGS. 4 and 5, the plate 32, which is disposed on the lower surface of the plate 31, includes throttle channels 43 connecting the manifolds 41 and the pressure chambers 42. A total of seven plates 32 to 38 positioned between the plate 31 and the nozzle plate 39 include communication channels 45 connecting the pressure chambers 42 and the nozzles 44.

The stacked plates 31 to 39 are joined to each other to constitute the channel unit 27. The channel unit 27 includes individual channels 47 each of which is branched from one of the manifolds 41 to reach the nozzle 44 through the throttle channel 43, the pressure chamber 42, and the communication channel 45.

As will be described later on, the ink-jet printer 1 according to this embodiment is capable of detecting the discharge failure of each nozzle 44. The ink-jet head 4 includes a part of the configuration detecting the discharge failure. As depicted in FIGS. 3 and 4, an opening 27*a* is formed at the front end of the channel unit 27. The opening 27*a* penetrates the metallic plates 31 to 38 of the plates 31 to 39 constituting the channel unit 27. Namely, the nozzle plate 39 includes no opening 27*a* (see FIG. 7). The opening 27 contains a light emitting part 60 which is used at the time of inspection of discharge failure of each nozzle 44. A light receiving part 61 is disposed to face the light emitting part 60 with the nozzle plate 39 interposed therebetween (see FIG. 7).

Next, the piezoelectric actuator 28 will be explained. As depicted in FIGS. 3 to 5, the piezoelectric actuator 28 includes piezoelectric layers 54, 55, individual electrodes 52, and a common electrode 56. The two piezoelectric layers 54, 55 are stacked on the upper surface of the vibration film 50 of the channel unit 27. The individual electrodes 52 are disposed on the upper surface of the upper piezoelectric layer 55 to face the pressure chambers 42 respectively. The common electrode 56 is disposed between two piezoelectric layers 54, 55 to extend across the pressure chambers 42.

The individual electrodes 52 are connected to a driver IC 57 via unillustrated wiring members. The common electrode 56 is always kept at a ground potential. Portions (hereinafter referred to as active portions 55*a*), of the upper piezoelectric layer 55, sandwiched between the individual electrodes 52 and the common electrode 56 are polarized in its thickness direction. One piezoelectric element 51 corresponding to one pressure chamber 42 is constituted by the individual electrode 52, an electrode portion, of the common electrode 56, facing the individual electrode 52, and the active portion 55*a* between the individual electrode 52 and the common electrode 56.

Figure 6:
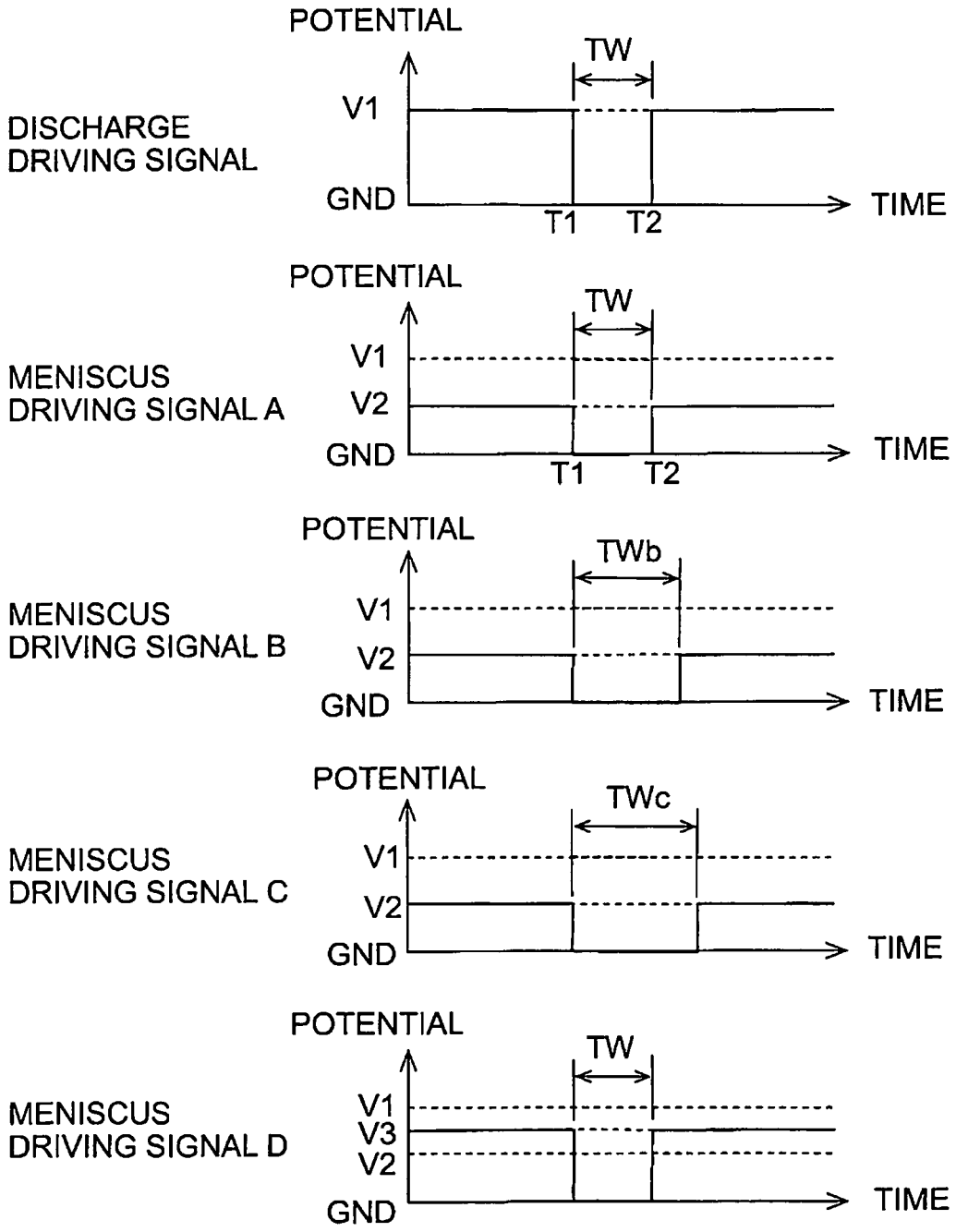
FIG. 6 depicts pulse waveforms of driving signals applied to piezoelectric elements by a driver IC.

The driver IC 57 applies driving signals to the driving electrodes 52 of the piezoelectric elements 51 corresponding to the pressure chambers 42 respectively. The driver IC 57 selects one of five driving signals depicted in FIG. 6 and applies it to each of the individual electrodes 52. As depicted in FIG. 6, each of the five driving signals is a pulse signal having one pulse. Single pulse application changes or switches the electrical potential of the individual electrode 52 in the order of high potential, low potential (ground potential), and high potential. The five driving signals, however, have mutually different pulse waveforms (pulse widths, peak or crest values of pulses, and the like). A discharge driving signal of the five driving signals is a signal for discharging the ink from each nozzle 44. The other four driving signals are meniscus driving signals A to D for vibrating the meniscus of ink in the discharge port of each nozzle 44. The meniscus driving signals A to D have respective peak values (potentials V2 and V3) lower than that of the discharge driving signal. In the present disclosure, a rapid change of the electric voltage for vibrating the meniscus is referred to as "a pulse" or "a pulse signal". A width of the pulse (a pulse width) means a time period in which the voltage is temporally changed for vibrating the meniscus. A pulse height means a voltage difference of the pulse signal which is changed for vibrating the meniscus. For example, in this embodiment, a change of the voltage (a high voltage→a low voltage→a high voltage) is referred to as a pulse signal, the width of the pulse means a time period of the low voltage, and the voltage difference means the difference between the low voltage and the high voltage.

When the driver IC 57 applies the discharge driving signal to the individual electrode 52 of each piezoelectric element 51, the piezoelectric element 51 moves or acts as follows. Noted that, the driver IC 57 drives each piezoelectric element 51 in accordance with so-called pull ejection in this embodiment. Namely, the vibration film 50 is drawn upward temporarily to increase the volume of the pressure chamber 42, and after the elapse of a certain period of time, the vibration film 50 is pushed downward to decrease the volume of the pressure chamber 42. Such pull ejection changes pressure twice so as to apply the pressure to the ink.

The electrical potential of the individual electrode 52 before application of the discharge driving signal is a high potential (potential V1). In this situation, the potential difference between the individual electrode 52 and the common electrode kept at the ground potential is caused to generate an electric field in the active portion 55*a* in its thickness direction. The direction of the generated electric field is same as the polarized direction of the active portion 55*a*. As a result, the active portion 55*a* extends in the thickness direction as the polarized direction and contracts in a planar direction. Along with the contraction of the active portion 55*a*, the vibration film 50 facing the pressure chamber 42 is bent to be convex toward the pressure chamber 42. That is, before the application of discharge driving signal, the vibration film 50 is bent toward the pressure chamber 42 as indicated by the two-dot chain line in FIG. 5, thereby making the volume of the pressure chamber 42 small.

Subsequently, when the discharge driving signal is applied, the electrical potential of the individual electrode 52 is switched from the high potential to the low potential (ground potential) at pulse fall timing (time T1) of the discharge driving signal. Then, the individual electrode 52 and the common electrode 56 have the same potential, and no electrode field acts on the active portion 55*a*. This eliminates the contraction of the active portion 55*a* to make the vibration film 50 flat, thereby increasing the volume of the pressure chamber 42. Accordingly, a negative pressure wave is generated in the ink in the pressure chamber 42.

After the elapse of the time of a pulse width TW of the discharge driving signal, the electrical potential of the individual electrode 52 is switched from the low potential to the high potential at pulse rise timing (time T2) of the discharge driving signal. This contracts the active portion 55*a* again to bend the vibration film 50 so that the vibration film 50 becomes convex toward the pressure chamber 42. Namely, the volume of the pressure chamber 42 reduces again to generate a positive pressure wave in the ink in the pressure chamber 42. The negative pressure wave generated in the pressure chamber 42 due to the increase in the volume of the pressure chamber 42 at the pulse fall timing (time T1) is reflected at end positions (the nozzle 44 and a connection part with the manifold 41) of the individual channel 47 to be inverted into the positive pressure wave. This positive pressure wave goes back to the pressure chamber 42 before the elapse of time of the pulse width TW. That is, since the pressure wave, which has been inverted to the positive pressure wave and has returned to the pressure chamber 42, overlaps with the pressure wave generated by the decrease in the volume of the pressure chamber 42, great pressure is generated in the ink in the pressure chamber 42. This pressure results in the discharge of the ink from the nozzle 44 communicating with the pressure chamber 42.

As understood from the foregoing, in order to apply the pressure to the ink efficiently, it is preferred that the volume of the pressure chamber 42 reduce at the timing at which the pressure wave, which is generated by the increase in the volume of the pressure chamber 42 at the time T1, returns to the pressure chamber 42. Thus, the pulse width TW of the discharge driving signal is determined according to propagation velocity of the pressure wave and a distance between the pressure chamber 42 and the nozzle 44 (or between the pressure chamber 42 and the connection part with the manifold 41). More specifically, the pulse width TW is substantially equal to the time in which the negative pressure wave generated by the decrease in the volume of the pressure chamber 42 is inverted into the positive pressure wave and the positive pressure wave returns to the pressure chamber 42.

The discharge driving signal results in the discharge of ink from the nozzle 44, and each meniscus driving signal vibrates the meniscus of ink in the discharge port 44*a* of the nozzle 44 without jetting the ink from the nozzle 44. When the driver IC 57 applies the meniscus driving signal to the individual electrode 52 of the piezoelectric element 51, the electrical potential of the individual electrode 52 is switched in the order of high potential, low potential (ground potential), and high potential as in the case of applying the discharge driving signal. Thus, the vibration film 50 bends is deformed to bend similarly. The peak value (the value of potential V) of pulse of the meniscus driving signal, however, is lower than the peak value V1 of pulse of the discharge driving signal. As a result, the pressure, which is applied to the ink in the pressure chamber 42 in the case of applying the meniscus driving signal, is smaller than the pressure, which is applied to the ink in the pressure chamber 42 in the case of applying the discharge driving signal. Thus, no ink is discharged from the nozzle 44 in the case of applying the meniscus driving signal. The meniscus driving signal vibrates the meniscus of ink in the discharge port 44*a* of the nozzle 44 in the up-down direction (axial direction of the nozzle 44). The vibration of meniscus (to be referred also to as meniscus vibration) agitates the ink in the nozzle 44 to prevent and eliminate the thickening of ink which would be otherwise caused by drying of ink. In this embodiment, one of the meniscus driving signals depicted in FIG. 6 is to be used when each nozzle 44 is subjected to the inspection of discharge failure, as described below.

<Discharge Failure Inspection and Recovery Operation of Discharge Performance>

Each nozzle 44 of the ink-jet head 4 may have discharge failures caused by various factors. For example, when the ink in the nozzle 44 is dry to increase its viscosity and/or when bubbles are mixed into the individual channel 47 including the pressure chamber 42, the nozzle 44 has any trouble in discharging the ink. Further, mixing of foreign substances, such as paper dust, into the nozzle 44 obstructs the discharge of ink from the nozzle 44. The printer 1 according to this embodiment has a function to inspect whether each nozzle 44 of the ink-jet head 4 has discharge failure.

When the nozzle 44 having discharge failure is detected, the recovery operation is required to recover the discharge performance of the nozzle 44. The printer 1 according to this embodiment can perform, as the recovery operation of discharge performance of the nozzle 44, the following three operations (1) to (3): (1) meniscus vibration of the nozzle 44 caused by application of the meniscus driving signal to the piezoelectric element 51; (2) flushing of the nozzle 44; (3) purge performed by the maintenance unit 7. The printer 1 selects the recovery operation, which is suitable for eliminating the discharge failure, in accordance with the detection result of the discharge failure, and performs the selected recovery operation.

Figure 7:
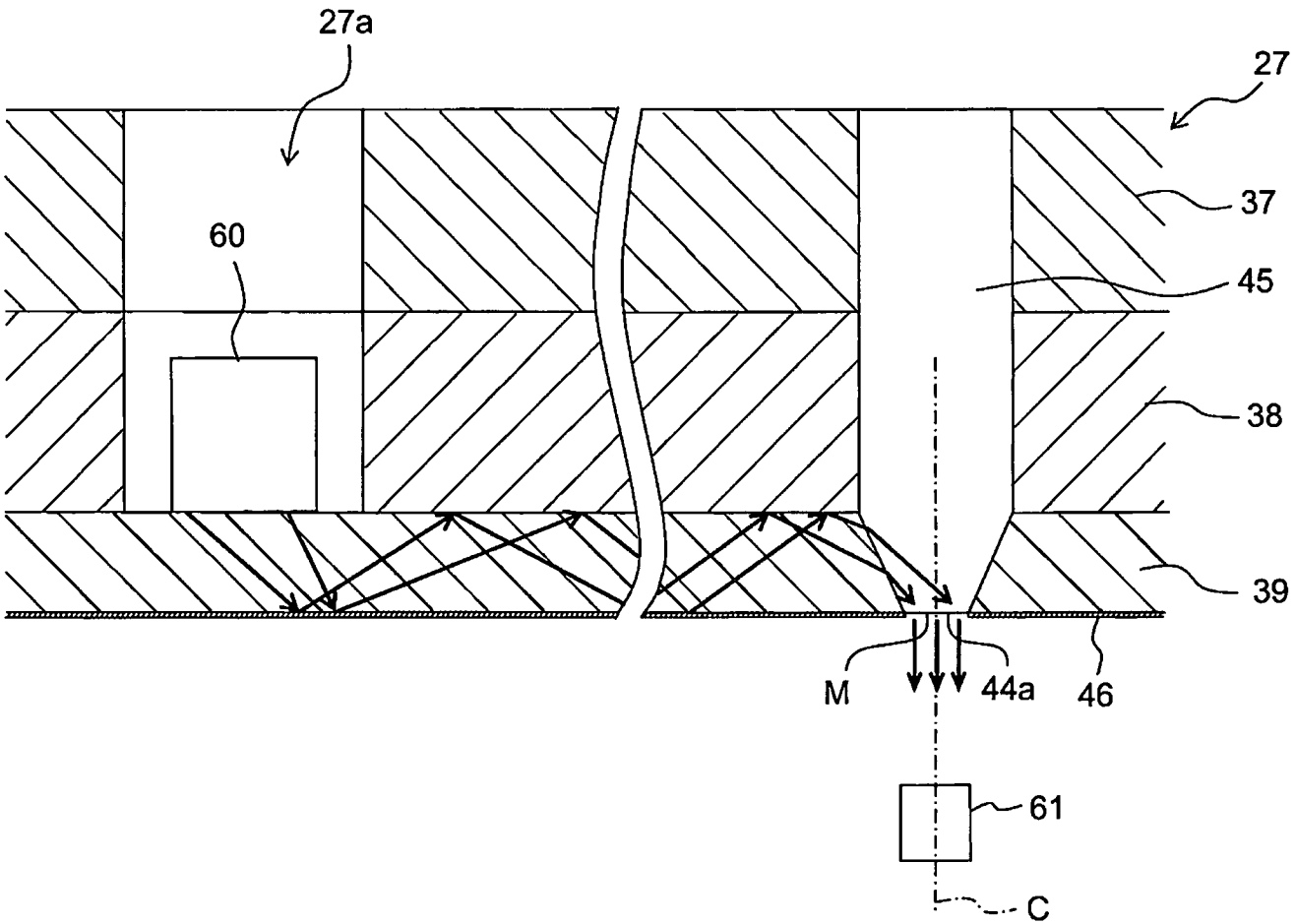
FIG. 7 is a cross-sectional view taken along the line VII-VII in FIG. 4.

At first, an explanation will be made about the configuration for detecting discharge failure of each nozzle 44 of the ink-jet head 4. As depicted in FIGS. 2, 3, and 7, the channel unit 27 includes the opening 27*a* which penetrates the plates 31 to 38 except for the nozzle plate 39. The light emitting part 60 is disposed on the bottom of the opening 27*a*. The light emitting part 60, which is formed of a light-emitting element such as a light-emitting diode, emits light downward.

The nozzle plate 39, which is disposed to close the lower side of the opening 27*a*, is made of a translucent synthetic resin. Thus, the light emitted from the light-emitting part 60 is introduced into the nozzle plate 39. The metal plate 38 disposed on the upper side of the nozzle plate 39 has a light-shielding property. Further, the ink-repellent film 46, which is disposed on the lower surface of the nozzle plate 39, has the light-shielding property. Thus, as depicted in FIG. 7, the light emitted from the light-emitting part 60 and introduced into the nozzle plate 39 travels in the nozzle plate 39 in its planar direction while being reflected at the plate 38 on the upper side of the nozzle plate 39 and the ink-repellent film 46 on the lower side of the nozzle plate 39, those of which are made of a light-shielding material. The light travelling in the nozzle plate 39 penetrates the ink in the nozzle 44 and escapes or leaks to the outside after passing through a meniscus M formed in the discharge port 44*a* of the nozzle 44.

The light-receiving part 61 is disposed below the nozzle plate 39, more specifically, directly below the discharge port 44*a* of the nozzle 44 (position on the line extending from the nozzle 44 in an axial direction C of the nozzle 44). The light-receiving part 61 is formed of a light-receiving element such as photodiode. The ink-jet head 4 supports the light-receiving part 61 by means of an appropriate support part (not depicted). The light-receiving part 61 receives the light, which has passed through the ink in the nozzle 44 and the meniscus M and travels in the axial direction C of the nozzle 44.

Figure 8A:
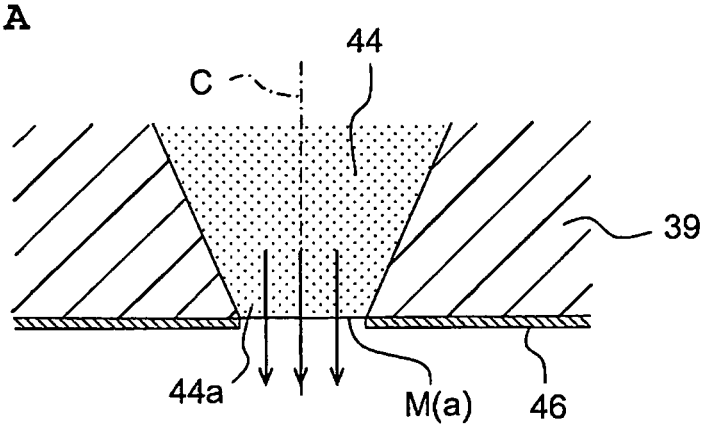
FIGS. 8A to 8C each depict the behavior of meniscus and FIG. 8D depicts the change in an amount of light received by a light receiving part.
Figure 8B:
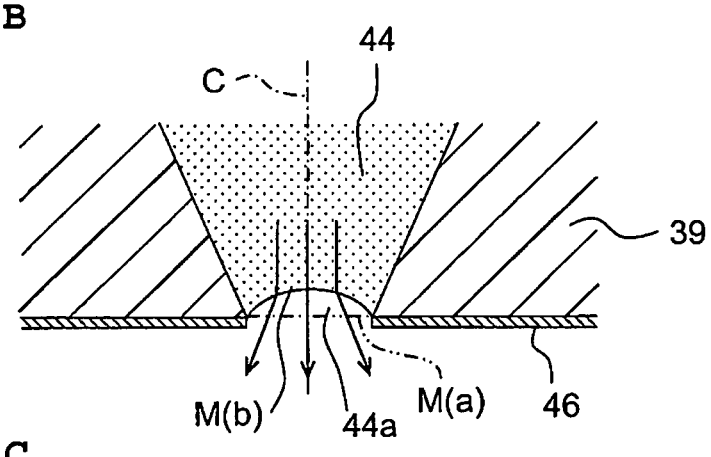
Figure 8C:
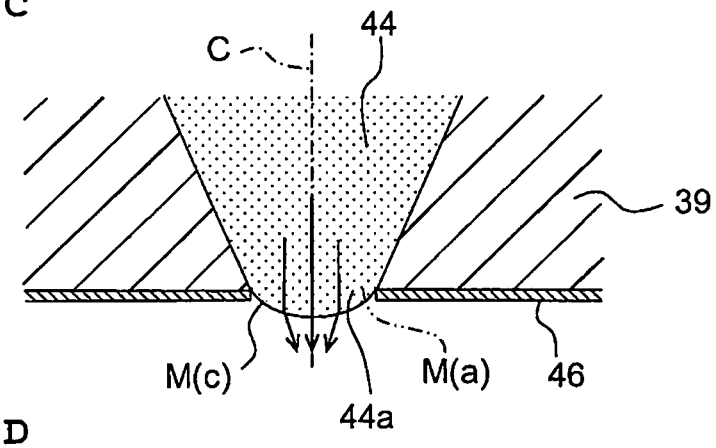
Figure 8D:
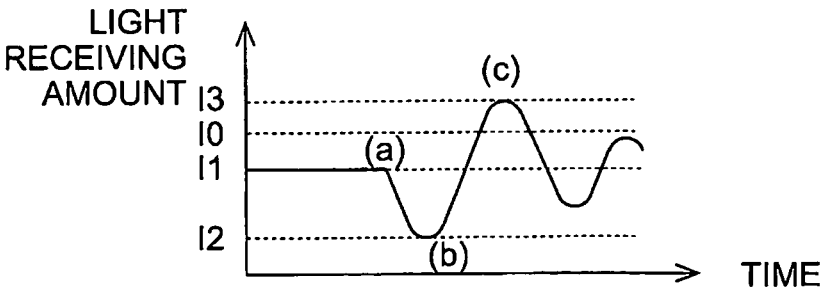

In the case of the inspection of discharge failure of the nozzle 44, the controller 8 controls the driver IC 57 to apply one of the meniscus driving signal depicted in FIG. 6 to the piezoelectric element 51 in a state that the light emitting part 60 emits the light to the ink in the nozzle 44. This vibrates the meniscus M in the nozzle 44 corresponding to the piezoelectric element 51. FIGS. 8A to 8C each depict the behavior of meniscus and FIG. 8D depicts the change in an amount of light received by the light receiving part 61. As depicted in FIG. 8A, the meniscus M is in a stationary state (hereinafter referred to as "a" state) before the meniscus driving signal is applied to the piezoelectric element 51. In this situation, a part of the light, which leaks from the nozzle 44 through the meniscus M, travels in the axial direction C of the nozzle 44 and then is received by the light-receiving part 61. As depicted in FIG. 8D, the amount of light received by the light-receiving part 61 under this situation is referred to as a light receiving amount "I1".

When one of the meniscus driving signals depicted in FIG. 6 is applied to the piezoelectric element 51 with the meniscus M being in the state depicted in FIG. 8A, the potential of the individual electrode 52 is switched to the ground potential at the pulse fall timing (time T1). This generates the negative pressure wave in the pressure chamber 42. In this situation, as depicted in FIG. 8B, the meniscus M of ink in the nozzle 44 has a concave shape ("b" state) by being drawn into the nozzle 44 more strongly than the "a" state. The meniscus M having the concave shape bends and diffuses the light leaking from the nozzle 44 to the outside through the meniscus M. This reduces the amount of light travelling in the axial direction C of the nozzle 44. Thus, as depicted in FIG. 8D, the light receiving amount 12 received by the light-receiving part 61 is smaller than the light receiving amount I1.

With the lapse of time of pulse width TW of the meniscus driving signal, the state of the meniscus M returns to the "a" state from the concave "b" state. Meanwhile, the potential of the individual electrode 52 is changed to high potential at the pulse rise timing (time T2). Thus, great pressure (positive pressure) is generated in the pressure chamber 42. The great pressure causes the meniscus M of the nozzle 44 to have a convex shape ("c" state), so that the meniscus M bulges toward the outside of the nozzle 44 more greatly than the "a" state, as depicted in FIG. 8C. The meniscus M having the convex shape bends the light leaking from the nozzle 44 to the outside through the meniscus M, and thus the light bent by the convex meniscus M is gathered or collected toward the inner side. This increases the amount of light passing in the axial direction C of the nozzle 44. Thus, as depicted in FIG. 8D, the light receiving amount I3 received by the light-receiving part 61 is greater than the light receiving amount I1.

The meniscus vibration generated in the nozzle 44 having discharge failure is smaller than that generated in the nozzle 44 having no discharge failure. Thus, the degree of convex of meniscus in the nozzle 44 having discharge failure is smaller than that in the nozzle 44 having no discharge failure. Namely, when the meniscus becomes convex in the nozzle 44 having discharge failure at the pulse rise timing, the degree of collection of light, which would be otherwise increased by the convex surface effect, is smaller than that in the nozzle 44 having no discharge failure. This reduces the light receiving amount 13 received by the light-receiving part 61. The printer 1 can detect whether or not each nozzle 44 has discharge failure, on the basis of a peak value I3 of the light receiving amount.

In this embodiment, as depicted in FIG. 6, the driver IC 57 can apply four kinds of meniscus driving signals having mutually different pulse waveforms to each piezoelectric element 51. Thus, further applying one of the four kinds of meniscus driving signals having mutually different pulse waveforms to the nozzle 44 having the discharge failure enables the printer 1 to calculate the cause of the discharge failure of the nozzle 44.

Figure 9:
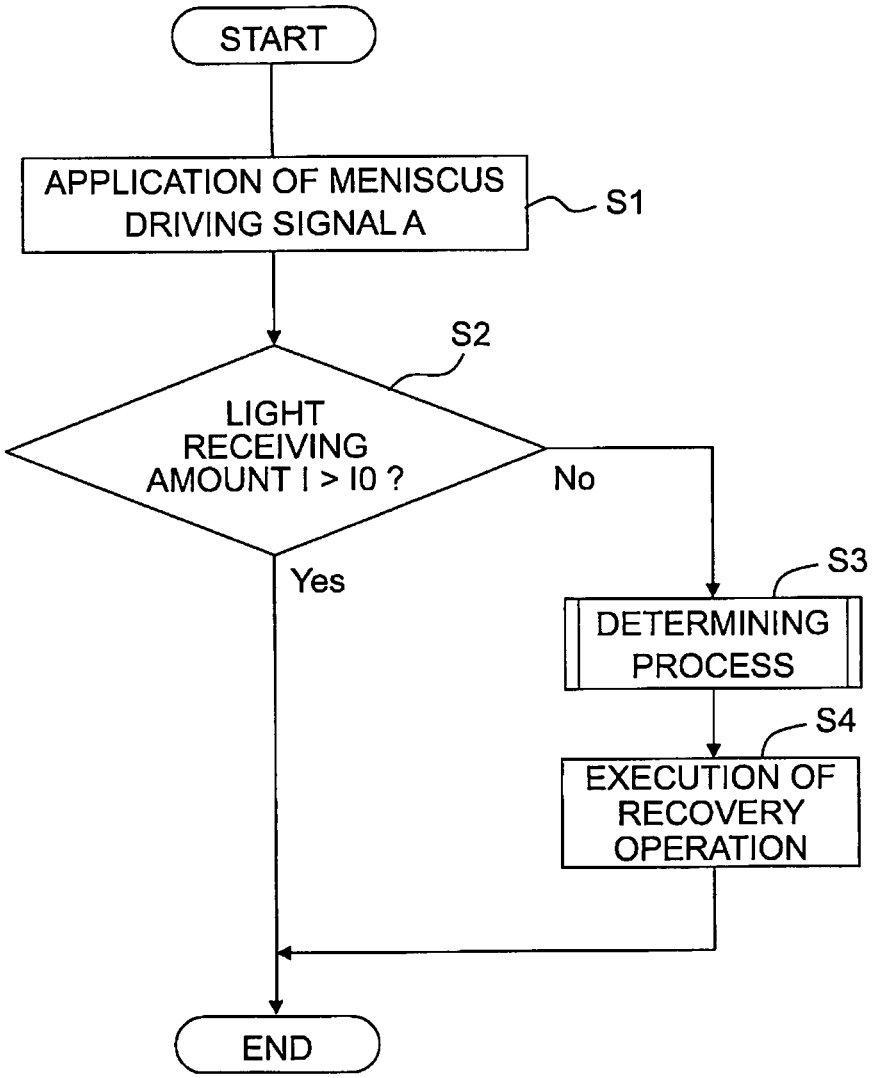
FIG. 9 is a flowchart of a judging process of discharge failure.
Figure 10A:
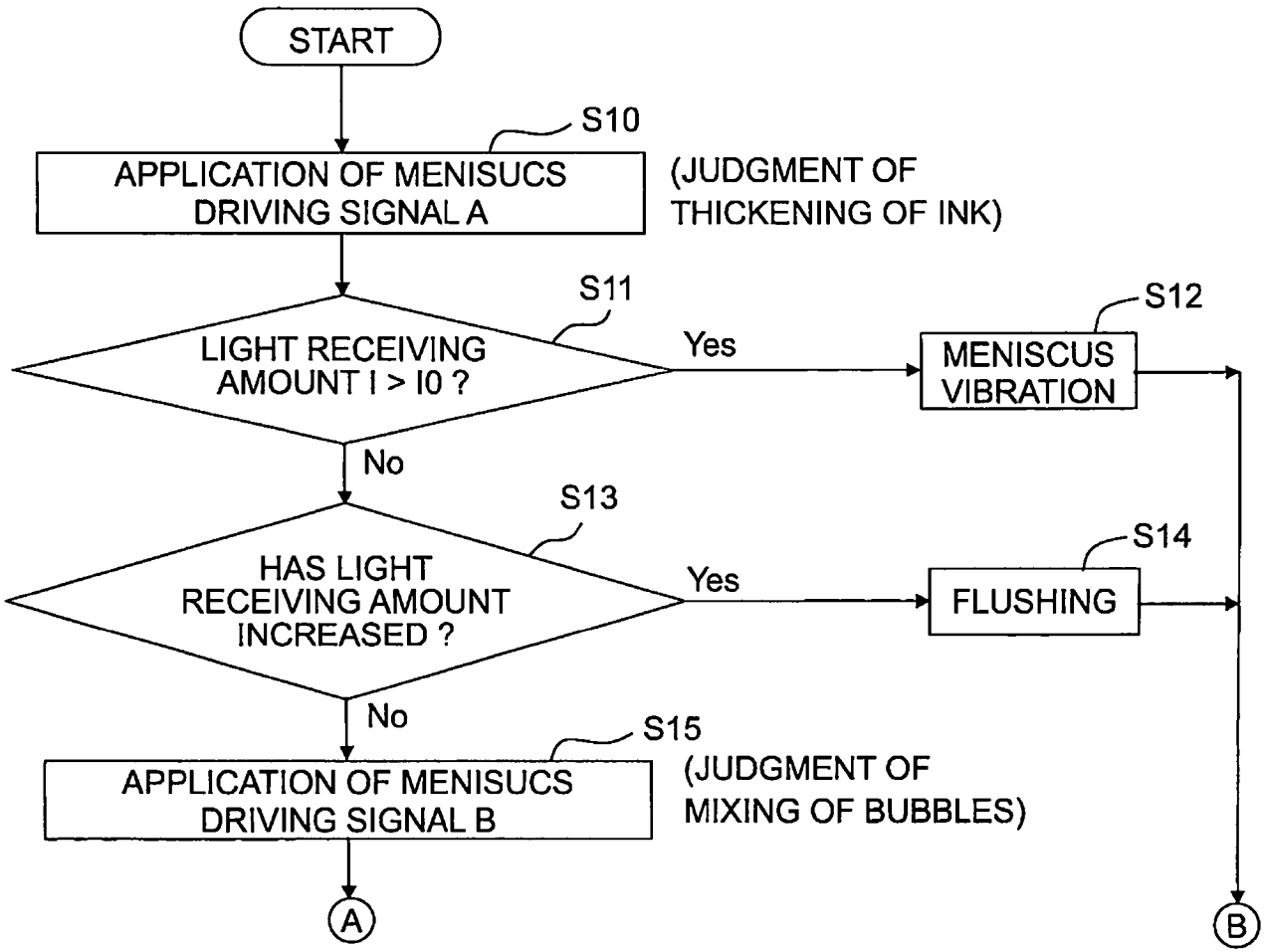
FIGS. 10A and 10B are a flowchart of a determining process of determining a recovery operation for a nozzle 44 having discharge failure.
Figure 10B:
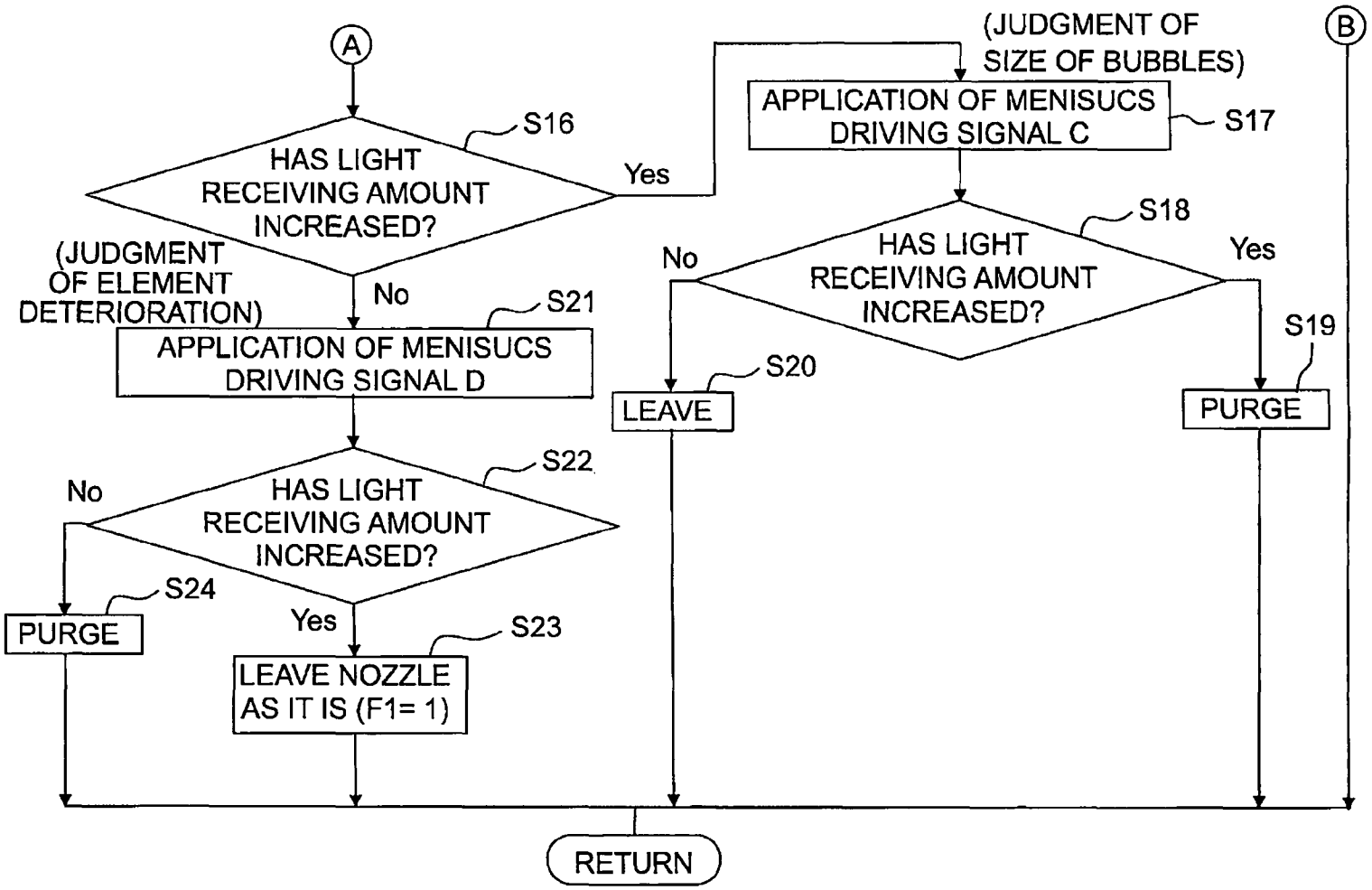

In the following, an explanation will be made about a series of processes concerning discharge failure inspection of each nozzle 44. In FIGS. 9 and 10, Si (where, i= 1, 2, 3 . . . ) indicates the number of each step. FIGS. 9 and 10 each show a process for one nozzle 44. When the inspection is performed for the nozzles 44, the processes indicated in FIGS. 9 and 10 are repeatedly performed by the number of nozzle 44 to be inspected. The CPU 20 reads programs stored in the ROM 21 depicted in FIG. 2 to execute the judging process of discharge failure shown in FIG. 9 and the determining process shown in FIGS. 10A and 10B.

The timing at which the inspection of discharge failure of each nozzle 44 is performed is not especially limited. For example, the printer 1, which is in a standby state in which no printing is performed on the recording sheet 100, may perform the inspection of discharge failure every time a predetermined amount of time elapses. The printer 1 may perform the inspection of discharge failure immediately before the printing on the recording sheet 100, for example, when the printer 1 receives data from the external apparatus 26. The printer 1 may perform the inspection of discharge failure immediately after the printer 1 is turned on. The printer 1 may perform the inspection of discharge failure at the timing at which the printer 1 has recovered from a sleep state.

<Judging Process of Discharge Failure>

In the judging process of discharge failure, the controller 8 controls the driver IC 57 to apply one of the meniscus driving signals depicted in FIG. 6 to the piezoelectric element 51 corresponding to the nozzle 44 to be inspected, in a state that the light emitting part 60 emits the light to each nozzle 44, as shown in FIG. 9. Here, the driver IC 57 applies, to the piezoelectric element 51, the meniscus driving signal A eliminating the thickening of ink (81). As shown in FIG. 6, the pulse width of the meniscus driving signal A is equal to the pulse width TW of the discharge driving signal (for example, TW=5 μs). The peak value V2 of the meniscus driving signal A is smaller than the peak value V1 of the discharge driving signal (for example, V1=20V, V2=10V). The meniscus driving signal A may be applied once or more than once. If the meniscus driving signal A is applied too many times, the ink in the nozzle 44 is liable to be agitated too much. This may cause mixing of bubbles in the nozzle 44. Thus, it is preferred that the meniscus driving signal A be applied, for example, five times or less.

When the driver IC 57 applies the meniscus driving signal A to the piezoelectric element 51, which corresponds to a nozzle 44 having no discharge failure, the meniscus of the nozzle 44 vibrates greatly to become largely convex toward the outside of the nozzle 44. Thus, the nozzle 44 having no discharge failure has a large amount of light, which travels in the axial direction C of the nozzle 44. Namely, when the peak (light receiving amount 13 in FIG. 8D) of the amount of light received by the light receiving part 61 exceeds a predetermined light receiving amount I0 (S2: Yes), the printer 1 judges that the nozzle 44 being inspected has no discharge failure and then completes the process. When the peak of the light receiving amount received by the light receiving part 61 is not more than the predetermined light receiving amount I0 (S2: No), the printer 1 judges that the nozzle 44 being inspected has discharge failure and then executes the process, as shown in FIGS. 10A and 10B, for determining the recovery operation which eliminates the discharge failure (S3). The output voltage of the light receiving part 61 is a voltage value obtained by photoelectrically converting the light received by the light receiving part 61. Examples of concrete values of output voltage of the light receiving part 61 in FIG. 8D are as follows. The voltage value corresponding to the predetermined light receiving amount I0 is 10V, when the output voltage value, which corresponds to the light receiving amount I1 obtained through the meniscus in the "a" state, is 8V; when the output voltage value, which corresponds to the light receiving amount 12 obtained through the meniscus in the "b" state, is 4V; and when the output voltage value, which corresponds to the light receiving amount 13 obtained through the meniscus in the "c" state, is 12V.

<Determining Process>

In the determining process shown in FIGS. 10A and 10B, the printer 1 determines an appropriate recovery operation to be performed for the nozzle 44, which has been judged in the inspection that discharge failure has occurred, on the basis of the cause of the discharge failure. In particular, one of the four kinds of meniscus driving signals depicted in FIG. 6 is applied to the piezoelectric element 51, which corresponds to the nozzle 44 having the discharge failure. When a single nozzle 44 has the discharge failure caused by a certain cause, the meniscus driving signal corresponding to the certain cause may be applied to the piezoelectric element 51. In this case, meniscus vibrates greatly to significantly change the amount of light received by the light receiving part 61. Thus, the printer 1 can determine the cause of the discharge failure and select the recovery operation suitable for the cause of discharge failure, on the basis of the meniscus driving signal used and the change in the light receiving amount.

In this embodiment, the printer 1 at first performs the judging process of discharge failure, and then performs the determining process for determining the recovery operation only for the nozzle 44, which has been judged that the amount of light received by the light receiving part 61 is small and thus discharge failure has occurred. Since no determining process is performed for normal nozzles 44, the time for the inspection of discharge failure can be shortened.

<1> Discharge Failure Caused by Thickening of Ink

In the determining process, the printer 1 at first performs the process for judging whether or not the cause of discharge failure is the thickening of ink. As shown in FIG. 10A, the controller 8 controls the driver IC 57 to apply the meniscus driving signal A in FIG. 6 to the piezoelectric element 51 corresponding to the nozzle 44, which has been judged in the judging process of discharge failure that discharge failure has occurred (S10).

In the judging process of discharge failure, the controller 8 has judged that the light receiving amount, which has been received by the light receiving amount 61 when the driver IC 57 has applied the meniscus driving signal A to the piezoelectric element 51, is not more than the predetermined value I0. In the determining process performed after the judging process, the driver IC 57 applies the meniscus driving signal A to the piezoelectric element 51 again. Here, the cause of discharge failure of the nozzle 44 may be the thickening of ink in the nozzle 44. If the degree of thickening of ink has not proceeded so much, the meniscus vibration caused when the meniscus driving signal A is applied in S1 of FIG. 9 agitates the ink in the nozzle 44. Thus, the thickening of ink is more likely to be partly eliminated before the application of the meniscus driving signal A in S10 of FIG. 10A. If so, when the meniscus driving signal A is applied in S10, the meniscus vibrates more greatly than the case in which the meniscus driving signal A is applied in S1. This results in the increase in the amount of light received by the light receiving part 61. Thus, when the amount of light received by the light receiving part 61 exceeds the predetermined value I0 at the time of applying the meniscus driving signal A in S10 (S11: Yes), the controller 8 judges that the cause of discharge failure is the thickening of ink which has not proceeded so much. Then, in order to recover this nozzle 44, the controller 8 selects, from among the recovery operations capable of being performed by the printer 1, the recovery operation of which ink discharge amount is smallest. In this embodiment, the controller 8 selects the meniscus vibration which agitates the ink in the nozzle 44 without discharging ink (S12).

Even when the light receiving amount received by the light receiving part 61 is not more than the predetermined value I0 (S11: No), the light receiving amount may be greater than that of when the driver IC 57 applies the meniscus driving signal A in S1 (S13: Yes). In this case, the controller 8 calculates that the application of the meniscus driving signal A in S10 has partly eliminated the thickening of ink. That is, the discharge failure is likely to be the thickening of ink also in this case. This case, however, is likely to have the thickening of ink, the degree of which is worse than the above case. Thus, the controller 8 selects the recovery operation having a larger ink discharge amount than that of the meniscus vibration, i.e., flushing (S14). The flushing means a recovery operation in which the ink is jetted from the nozzles for recovering the nozzles by applying the driving signal to the piezoelectric element.

When the controller 8 compares two light receiving amounts which have received by the light receiving part 61 at different timings, it is preferred that the influence of detection error in the light receiving part 61 be taken into account. For example, when the difference between two light receiving amounts exceeds not less than 10%, the controller 8 can judge that one of the two light receiving amounts is greater than the other one. The same is true for other steps described below. In this embodiment, the meniscus driving signal applied in S10 of the determining process is the same as that applied in S1 of the judging process of discharge failure. Namely, the meniscus driving signal A is applied both in S1 and S10. The meniscus driving signal applied in S10, however, may be different from that applied in S1.

<2> Discharge Failure Caused by Mixing of Bubbles

When the light receiving amount fails to increase after the meniscus driving signal is applied twice in S1 of FIG. 9 and S10 of FIG. 10A (S13: No), the control 8 calculates that the cause of discharge failure is not the thickening of ink. Thus, the controller 8 subsequently judges whether or not the cause of discharge failure is mixing of bubbles into the individual channel 47 including the pressure chamber 42.

The pulse width of the meniscus driving signal A of FIG. 6 is the same as the pulse width TW of the discharge driving signal. As described above, the pulse widths TW of the discharge driving signal and the meniscus driving signal are set to have a value by which pressure can be applied to the ink at effective timing. Namely, the pulse width TW is substantially equal to the time in which the negative pressure wave generated in the case of decreasing the volume of the pressure chamber 42 is inverted to the positive pressure wave and the positive pressure wave returns to the pressure chamber 42.

When bubbles are mixed in the individual channel 47, the pressure wave propagates via the bubbles. This reduces the propagation velocity of the pressure wave, which has been generated in the pressure chamber 42, in the individual channel 47. Thus, when the driver IC 57 applies the meniscus driving signal A having the pulse width TW, the pressure applied to the ink is insufficient, thereby causing the discharge failure. In other words, when bubbles are mixed in the individual channel 47, the controller 8 can increase the pulse width in response to the decrease in propagation velocity of pressure wave so as to raise the pressure to be applied to the ink.

Thus, the controller 8 controls the driver IC 57 to apply the meniscus driving signal B (S15) to the piezoelectric element 51. The meniscus driving signal B has a pulse width TWb greater than the pulse width TW of the meniscus driving signal A. When the meniscus driving signal B having the great pulse width TWb is applied in the state that bubbles are mixed in the individual channel 47, the pressure applied to the ink is greater than that in the case of applying the meniscus driving signal A. This results in large meniscus vibration in the nozzle 44, thereby increasing the light receiving amount received by the light receiving part 61. Thus, when the light receiving amount received by the light receiving part 61 in the case of applying the meniscus driving signal B is greater than that in the case of applying the meniscus driving signal A (S16: Yes), the controller 8 calculates that bubbles are mixed in the individual channel 47. Preferably, the pulse width TWb of the meniscus driving signal B can be 1.1 to 1.5 times greater than the pulse width TW of the meniscus driving signal A. For example, when the pulse width TW of each of the discharge driving signal and the meniscus driving signal A in FIG. 6 is 5 μs, the pulse width TWb of the meniscus driving signal B is 6 μs.

The reason why the pulse width TWb of the meniscus driving signal B is made to be not less than 1.1 times greater than the pulse width TW of the meniscus driving signal A is as follows. Namely, the increase in light receiving amount is determined by the controller 8 on condition that the light receiving amount has been increased by not less than 10% with detection error. The reason why the pulse width TWb of the meniscus driving signal B is made to be not more than 1.5 times greater than the pulse width TW of the meniscus driving signal A is as follows. The pulse width, which corresponds to the propagation velocity of pressure wave generated when a bubble having a possible maximum size is mixed, is 1.5 times greater than the pulse width of the meniscus driving signal A.

Of the three recovery operations including meniscus vibration, flushing, and purge, the purge, in which the maintenance unit 7 forcibly discharges ink from the nozzle 44, is the most suitable operation to discharge bubbles. Thus, the controller 8 selects the purge as the recovery operation when the light receiving amount received by the light receiving part 61 has increased in the case of applying the meniscus driving signal B.

When bubbles are mixed in the individual channel 47, the bubbles may be small. In this case, the bubbles are likely to naturally disappear by blending with the ink, without discharging the bubbles through the purge. Thus, in this embodiment, when the light receiving amount has increased in the case of applying the meniscus driving signal B (S16: Yes), the controller 8 controls the driver IC 57 to apply the meniscus driving signal C to the piezoelectric element 51 (S17). The meniscus driving signal C has a pulse width TWc greater than the pulse width TWb of the meniscus driving signal B. For example, when the pulse width TW of the meniscus driving signal A is 5 μs and the pulse width TWb of the meniscus driving signal B is 6 μs, the pulse width TWc of the meniscus driving signal C is 7 μs. The numerical value (6 μs) of the pulse width TWb of the meniscus driving signal B means the time in which the pressure wave, which has been generated when the individual channel 47 has small bubbles which may naturally disappear, is inverted to positive pressure wave and the positive pressure wave returns. The numerical value (7 μs) of the pulse width TWc of the meniscus driving signal C means the time in which the pressure wave, which has been generated when the individual channel 47 has big bubbles which may not naturally disappear and may be required to be discharged from the nozzle 44 through the purge, is inverted to positive pressure wave and the positive pressure wave returns.

The propagation velocity of pressure wave reduces in greater degree with bigger bubbles. Thus, when the light receiving amount in the case of applying the meniscus driving signal C is greater than the light receiving amount in the case of applying the meniscus driving signal B (S18: Yes), the controller 8 calculates that the individual channel 47 has big bubbles, and then selects the purge (S19). When the light receiving amount fails to increase in the case of applying the meniscus driving signal C, the controller 8 calculates that the bubbles in the individual channel 47 are not so big. Thus, the controller 8 does not perform the recovery operation for the nozzle 44 to leave the nozzle 44 as it is (S20).

<3> Deterioration of Piezoelectric Element 51 or Discharge Failure Caused by Mixing of Foreign Substances When the light receiving amount fails to increase in S16, the controller 8 calculates that neither thickening of ink nor mixing of bubbles occur. The cause of discharge failure other than the above may be the deterioration of the piezoelectric element 51 or the mixing of foreign substances into the individual channel 47 including the nozzle 44. The deterioration of the piezoelectric element 51 causes such a phenomenon that the piezoelectric characteristics of the active portion 55*a* deteriorate to reduce the deformation amount when a predetermined voltage is applied to a portion, of the piezoelectric element 51, between the individual electrode 52 and the common electrode 56. In such a case, increasing the peak value (voltage V) of the meniscus driving signal can raise the pressure to be applied to the ink. When the cause of discharge failure is mixing of foreign substances into the individual channel 47, a part of the individual channel 47 is blocked by the foreign substances. In such a case, increasing the peak value of the meniscus driving signal hardly raises the pressure to be applied to the ink.

Thus, the controller 8 controls the driver IC 57 to apply the meniscus driving signal D to the piezoelectric element 51 (S21). The meniscus driving signal D has a peak value (potential V) higher than the meniscus driving signal A. When the light receiving amount in the case of applying the meniscus driving signal D is greater than that in the case of applying the meniscus driving signal A (S22: Yes), the controller 8 calculates that the piezoelectric element 51 has deteriorated. Preferably, the peak value V3 of the meniscus driving signal D can be smaller than the peak value V1 of the discharge driving signal and can be not less than 1.1 times greater than the peak value V2 of the meniscus driving signal A. For example, when V1 is 20V and V2 is 10V, the peak value V3 of the meniscus driving signal D is 12V. The reason why the peak value V3 of the meniscus driving signal D is made to be not less than 1.1 times greater than the peak value V1 of the meniscus driving signal A is as follows. Namely, the increase in light receiving amount is determined by the controller 8 on condition that the light receiving amount has been increased by not less than 10% with detection error. Further, the peak value V3 of the meniscus driving signal D is required to be smaller than a minimum peak value for discharging the ink so as not to discharge the ink from the nozzle 44 at the time of applying the meniscus driving signal D.

When the cause of discharge failure is the deterioration of the piezoelectric element 51, all of the recovery operations including meniscus vibration, flushing, and purge can not recover the discharge performance of the nozzle 44. Thus, when the light receiving amount has increased in S22 (S22: Yes), the nozzle 44 is left as it is without being subjected to any recovery operation (S23). Further, a flag F1, which indicates the deterioration of the piezoelectric element 51, is set to 1 in this nozzle 44. Although the discharge performance of the nozzle 44 can not be recovered, it is possible to prevent such a situation that the printer 1 consumes ink wastefully by performing an unnecessary recovery operation of the nozzle 44, the discharge performance of which can not be recovered through the three recovery operations.

When the light receiving amount fails to increase in the case of applying the meniscus driving signal D (S22: No), the controller 8 calculates that the cause of discharge failure is not the deterioration of the piezoelectric element 51. Thus, the controller 8 selects any of the recovery operations. At this stage, since the judgements relating to thickening of ink and mixing of bubbles have been completed, the controller 8 calculates that the cause of discharge failure is mixing of foreign substances into the individual channel 47. In order to reliably discharge the foreign substances mixed in the individual channel 47 including the nozzle 44, the purge, which forcibly discharges ink from each nozzle 44, is the most suitable recovery operation. Thus, the controller 8 selects the purge as the recovery operation (S24).

As described above, the printer 1 performs the judging process of discharge failure for each nozzle 44 and the determining process of recovery operation for the nozzle 44 having the discharge failure. These processes are repeatedly performed for respective nozzles 44 of the ink-jet head 4. The inspection of discharge failure may be performed for all of or some of the nozzles 44 of the ink-jet head 4. For example, the inspection may be performed only for the nozzles 44 through which an ink having a certain color, of the inks of four colors, is discharged.

Regarding the cause of discharge failure of each nozzle 44, thickening of ink has the highest occurrence frequency, mixing of bubbles has the second highest occurrence frequency, and the deterioration of the piezoelectric element 51 has the lowest occurrence frequency. Thus, in view of the reduction of inspection time and the like, it is preferred that each of the judgment steps be performed in the order described in the above embodiment. Each of the judgment steps, however, may be performed in any order other than the above.

<Execution of Recovery Operation>

After determining the recovery operation for each nozzle 44, the controller 8 controls the driver IC 57 or the maintenance unit 7 to perform the selected recovery operation (S4 of FIG. 9). Since the cap 9 of the maintenance unit 7 covers all of the nozzles 44 of the ink-jet head 4, all of the nozzles 44 are subjected to the purge inescapably. Thus, when the controller 8 selects the purge as the recovery operation for at least one nozzle 44 of the inspected nozzles 44, the purge is performed for all of the nozzles 44 irrespective of the recovery operation of other nozzles 44. When the purge is selected for no nozzles 44, the recovery operation individually selected for each nozzle 44, namely the meniscus vibration or flushing, is performed for each nozzle 44.

Noted that a user may be informed of the recovery operation determined in the determining process to finally judge and perform the recovery operation manually, instead of the automatic execution of the recovery operation by the printer 1. For example, in order to allow the user to perform the final judgement, the controller 8 may display the recovery operation determined in the determining process on the display of the operation panel 24 (see FIG. 2) or may send information to the external apparatus 26 such as a personal computer to display the information on its display or the like.

Figure 11:
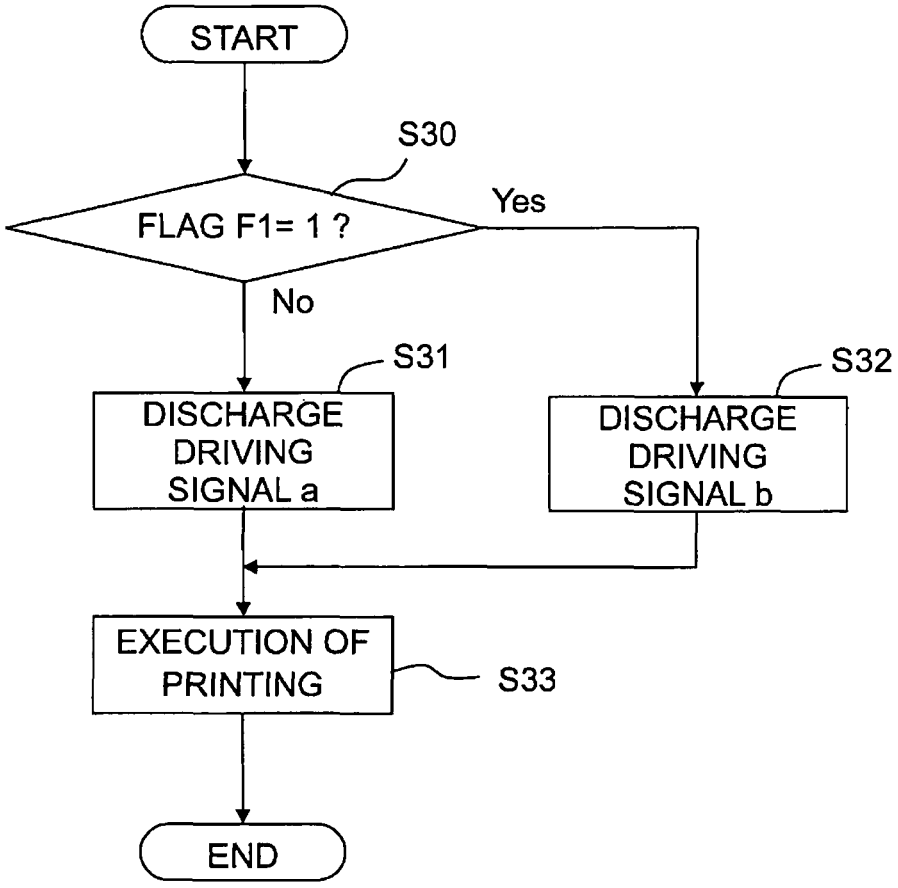
FIG. 11 is a flowchart of a printing process.
Figure 12:
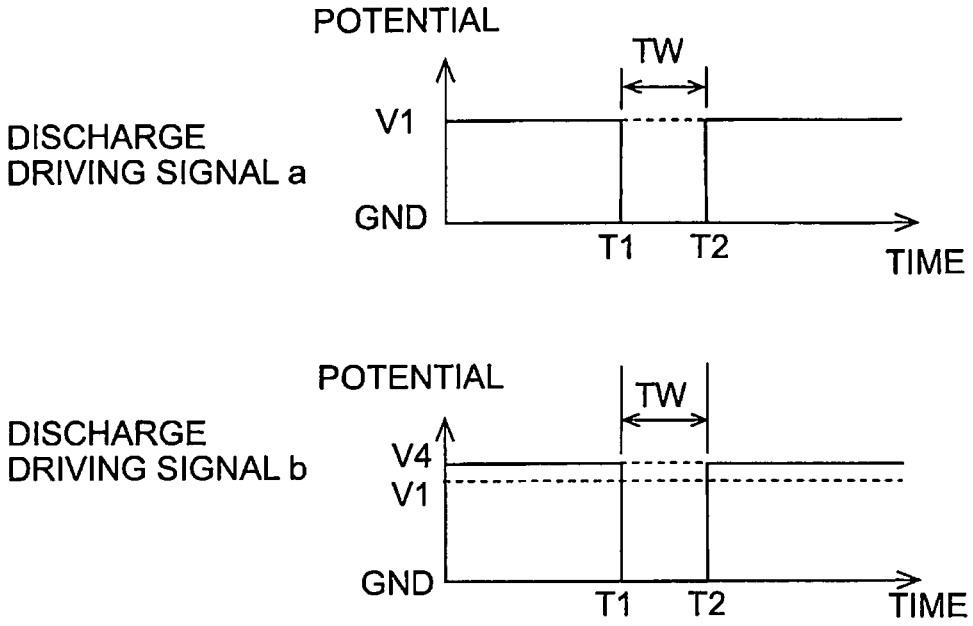
FIG. 12 depicts pulse waveforms of two kinds of discharge driving signals having different peak or crest values.

When the controller 8 calculates that the cause of discharge failure is the deterioration of the piezoelectric element 51 on the basis of the increase in light receiving amount in S22 of the determining process of FIG. 10B (S22: Yes), the controller 8 can increase the peak value of the discharge driving signal to be applied from the driver IC 57 to the deteriorated piezoelectric element 51 at the time of printing on the recording sheet 100. The printing process shown in the flowchart of FIG. 11 is performed when a printing command is inputted from the external apparatus 26. When the flag F1 is set to 0, namely when the piezoelectric element 51 has no deterioration (S30: No), the controller 8 selects a discharge driving signal a of FIG. 12A (S31). When the flag F1 is set to 1, namely when the piezoelectric element 51 has deterioration (S30: Yes), the controller 8 selects a discharge driving signal b, depicted in FIG. 12B, of which peak value V4 (for example, 24V) is greater than a peak value V1 (for example, 20V) of the discharge driving signal a (S32). The controller 8 controls the driver IC 57 to apply the discharge driving signal selected for each piezoelectric element 51, and then the ink-jet head 4 performs the printing (S33). Accordingly, the discharge driving signal having the higher peak value can improve the discharge performance, of the nozzle 44, which has been lowered by the deterioration of the piezoelectric element 51. The printing process shown in FIG. 11 is performed such that the CPU 20 reads and executes the program stored in the ROM 21 depicted in FIG. 2.

The peak value V4 of the discharge driving signal b can be determined, particularly as follows. Namely, when the light receiving amount received by the light receiving part 61 in the case of applying the meniscus driving signal D is set to "Id", the peak value V4 is determined to meet $V4 \geq V1 \times I0/Id$ on the basis of the ratio of the light receiving amount Id to the light receiving amount JO which is a determination threshold of discharge failure (V1:V4=Id:I0).

In the above embodiment, the printer 1 corresponds to a liquid discharge apparatus of the present teaching. The ink-jet head 4 corresponds to a liquid discharge head of the present teaching. The channel unit 27 corresponds to a channel structure of the present teaching. The driver IC 57 corresponds to a driving unit of the present teaching. The controller 8 corresponds to a controller of the present teaching. The meniscus driving signal A applied in S1 of FIG. 9 corresponds to a first meniscus driving signal of the present teaching. The meniscus driving signal A applied in S10 of FIG. 10A corresponds to a second meniscus driving signal of the present teaching. The meniscus driving signal B corresponds to a third meniscus driving signal of the present teaching. The meniscus driving signal C corresponds to a fourth meniscus driving signal of the present teaching. The meniscus driving signal D corresponds to a fifth meniscus driving signal of the present teaching. The meniscus vibration selected in S12 of FIG. 10A corresponds to a first recovery operation of the present teaching. The flushing selected in S14 of FIG. 10A corresponds to a second recovery operation of the present teaching. The purge selected in S19 of FIG. 10B corresponds to a third recovery operation of the present teaching.

Subsequently, an explanation will be made about modified embodiments in which various changes or modifications are added to the above embodiment. The constitutive parts or components, which are the same as or equivalent to those of the embodiment described above, are designated by the same reference numerals, any explanation of which will be omitted as appropriate.

Figure 13:
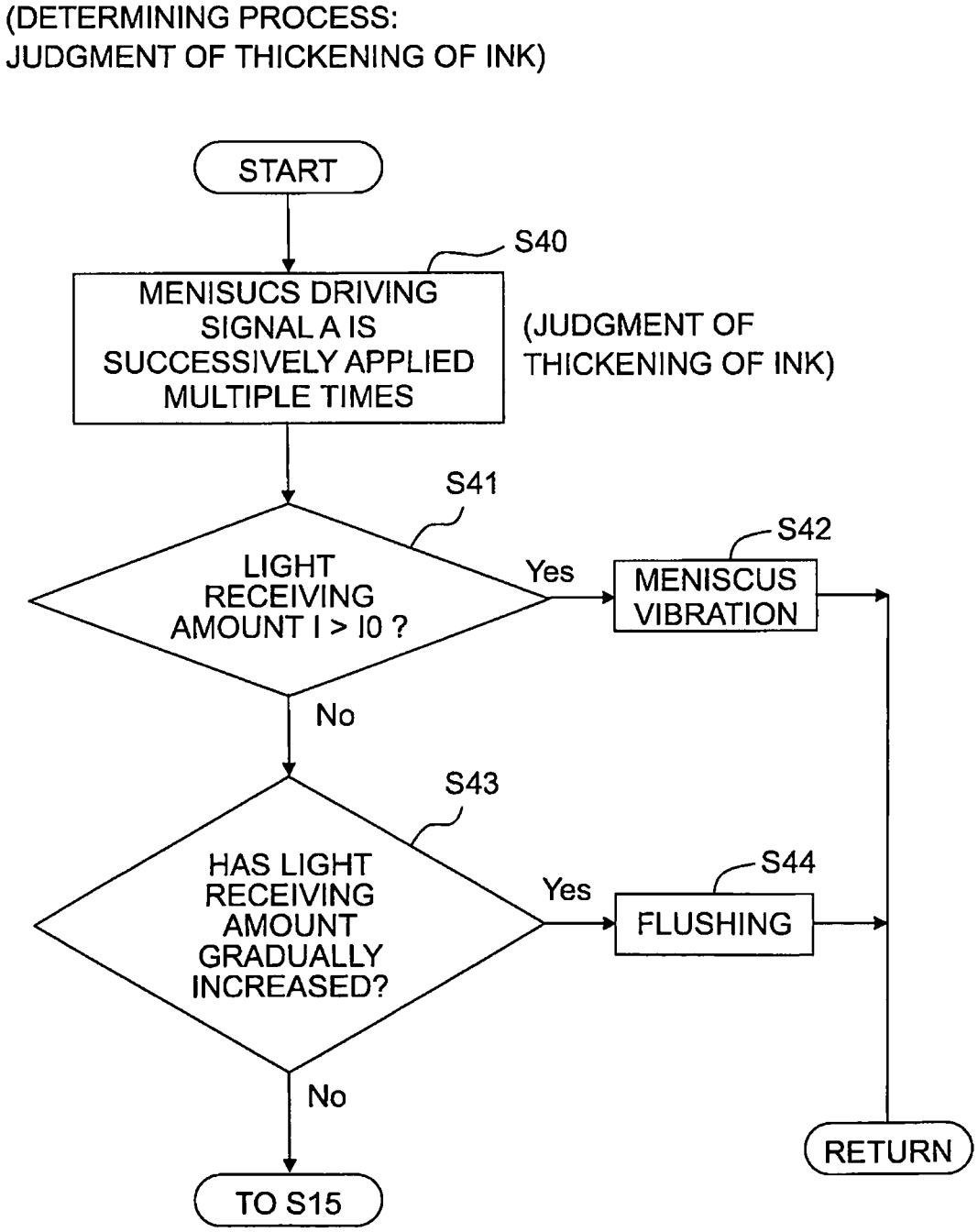
FIG. 13 is a flowchart indicating a part of the determining process according to a modified embodiment.

The step for judging the degree of thickening of ink (S13) shown in FIG. 10A according to the above embodiment may be changed as follows. As shown in FIG. 13, the controller 8 controls the driver IC 57 to successively apply the meniscus driving signal A to the piezoelectric element 51 multiple times, thereby vibrating the meniscus multiple times (S40). In this case, when the light receiving amount received by the light receiving part 61 exceeds the predetermined value I0 (S41: Yes), the controller 8 selects the meniscus vibration as the recovery operation (S42). This determination or selection is identical to that of the above embodiment.

Even when the light receiving amount received by the light receiving part 61 is not more than the predetermined value I0 (S41: No), the light receiving amount received by the light receiving part 61 may increase with successive application of the meniscus driving signal A. In this case, the controller 8 calculates that the ink has been agitated by vibrating the meniscus multiple times to reduce the thickening of ink to some degree. Thus, when the light receiving amount increases by successively applying the meniscus driving signal A multiple times (S43: Yes), the controller 8 judges that the thickening of ink has proceeded to some degree and selects the flushing as the recovery operation (S44). The phase "the light receiving amount increases by successively applying the meniscus driving signal A multiple times" means that the peak (light receiving amount 13 of FIG. 8D) of the light receiving amount, obtained when each of the meniscus driving signals is applied, gradually increases.

In the above embodiment, the controller 8 selects the meniscus vibration as the first recovery operation eliminating the thickening of ink which has not proceeded so much, and the controller 8 selects the flushing as the second recovery operation eliminating the thickening of ink which has proceeded to some degree. The combination of the first and second recovery operations, however, is not limited to the above. Any combination of two recovery operations may be adopted, provided that the two recovery operations have mutually different ink discharge amounts.

For example, the first recovery operation may be the meniscus vibration and the second recovery operation may be the purge. Or, the first recovery operation may be the flushing and the second recovery operation may be the purge. Further, the flushing or the purge may have several kinds of operations having different degrees of intensity (different ink discharge amounts), and the driver IC 57 or the maintenance unit 7 may control the different degrees of intensity. In such a case, the first recovery operation may be strong flushing and the second recovery operation may be weak flushing. Alternatively, the first recovery operation may be weak purge and the second recovery operation may be strong purge.

The driving signals depicted in FIG. 6 according to the above embodiment are rectangular pulse signals of which rise time and fall time are substantially zero. The driving signals, however, may be pulse signals each having a rise time Ta and a fall time Tb.

When the driving signals are the pulse signals each having the rise time Ta and the fall time Tb, the process (S21) for judging the deterioration of the piezoelectric element 51 shown in FIG. 10B according to the above embodiment may be changed as follows.

In the step (S21) for judging the deterioration of the piezoelectric element 51 shown in FIG. 10B according to the above embodiment, a meniscus driving signal E may be applied to the piezoelectric element 51. The meniscus driving signal E has a rise time Ta and fall time Tb shorter than those of the meniscus driving signal A. For example, when the rise time Ta and fall time Tb of the meniscus driving signal A are each 2 μs, the rise time Ta and fall time Tb of the meniscus driving signal E are each 1 μs.

The short rise time Ta and short fall time Tb of the pulse signal rapidly change the voltage to be applied to the piezoelectric element 51, and thus great pressure can be applied to the ink in the pressure chamber 42. When the meniscus driving signal E having the short rise time Ta and short fall time Tb is applied to the piezoelectric element 51, the light receiving amount received by the light receiving part 61 may increase. In this case, the controller 8 calculates that the piezoelectric element 51 has deteriorated.

Figure 14:
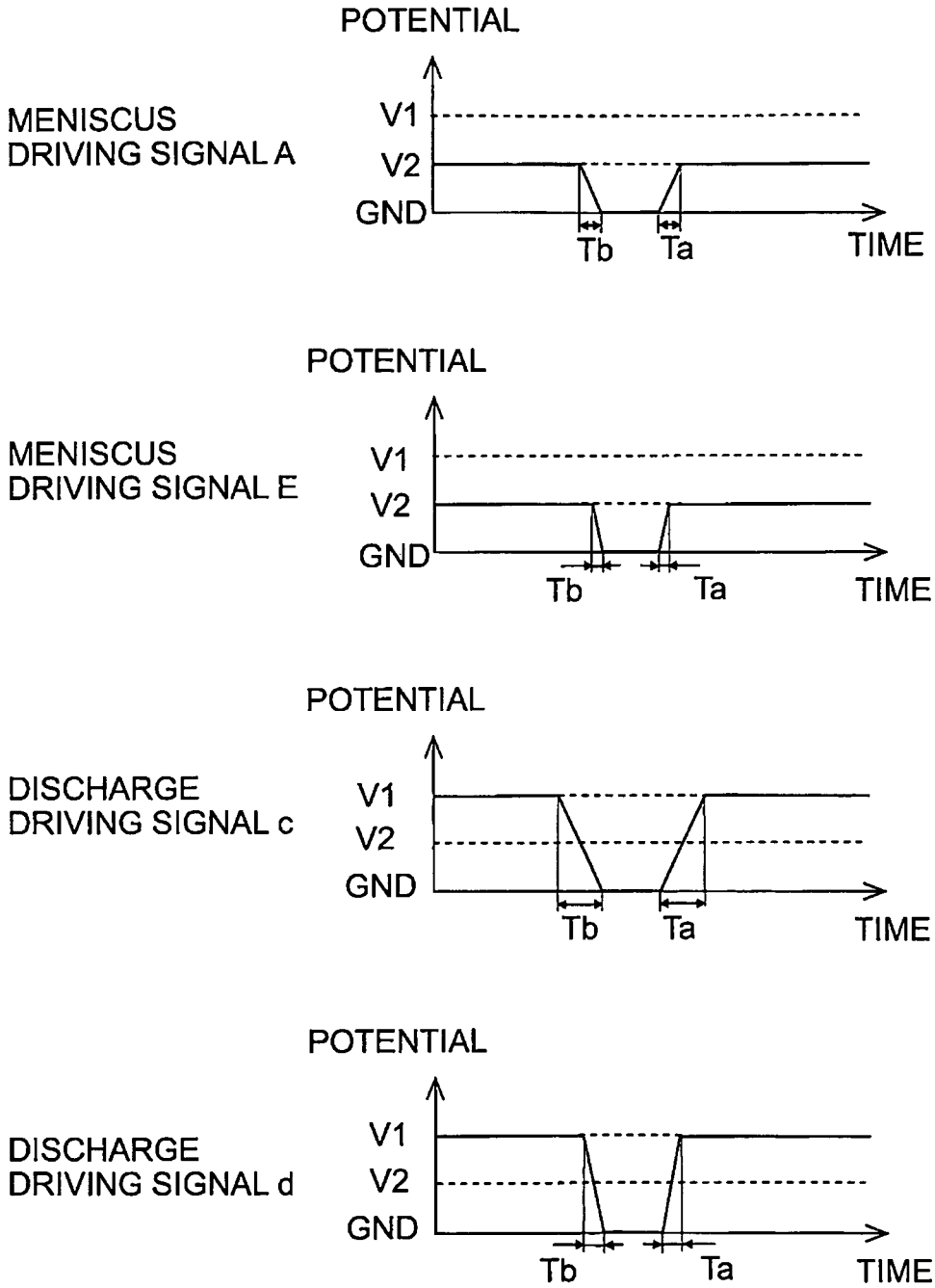
FIG. 14 depicts pulse waveforms of driving signals according to a modified embodiment.
Figure 15:
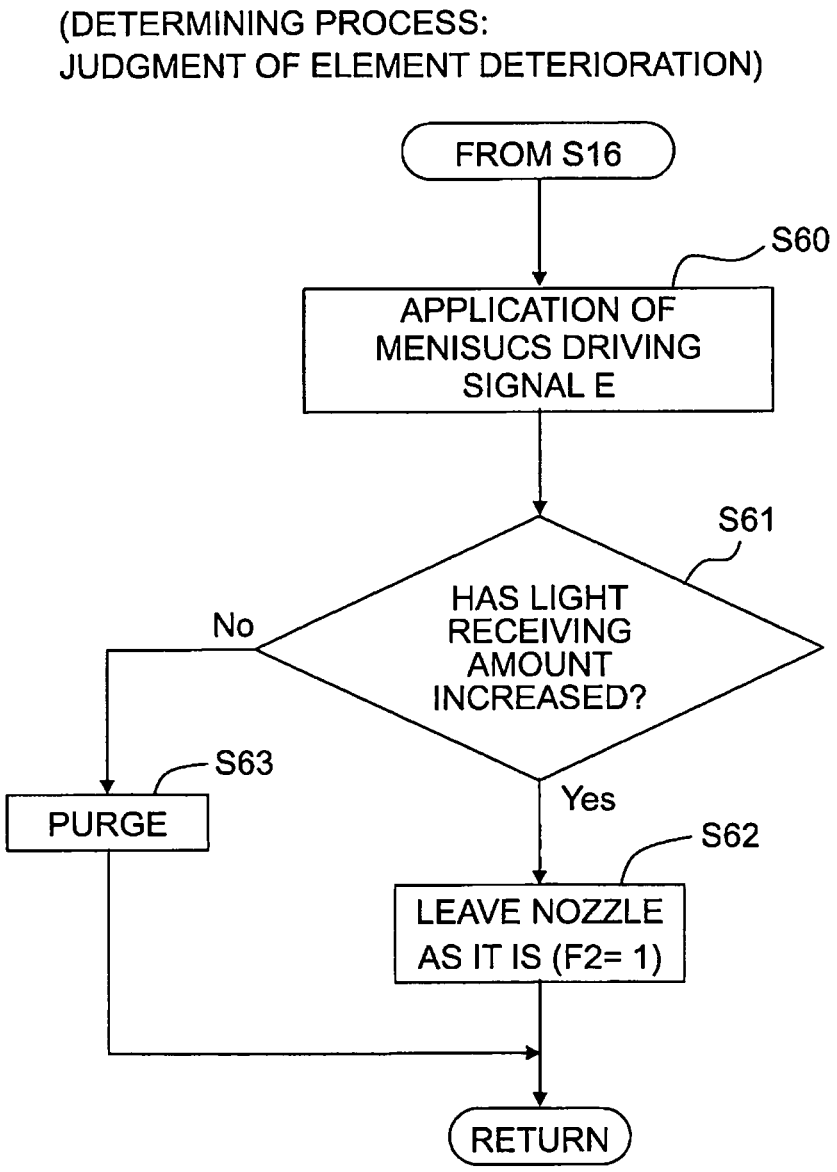
FIG. 15 is a flowchart showing a part of the determining process in which a meniscus driving signal depicted in FIG. 14 is used.
Figure 16:
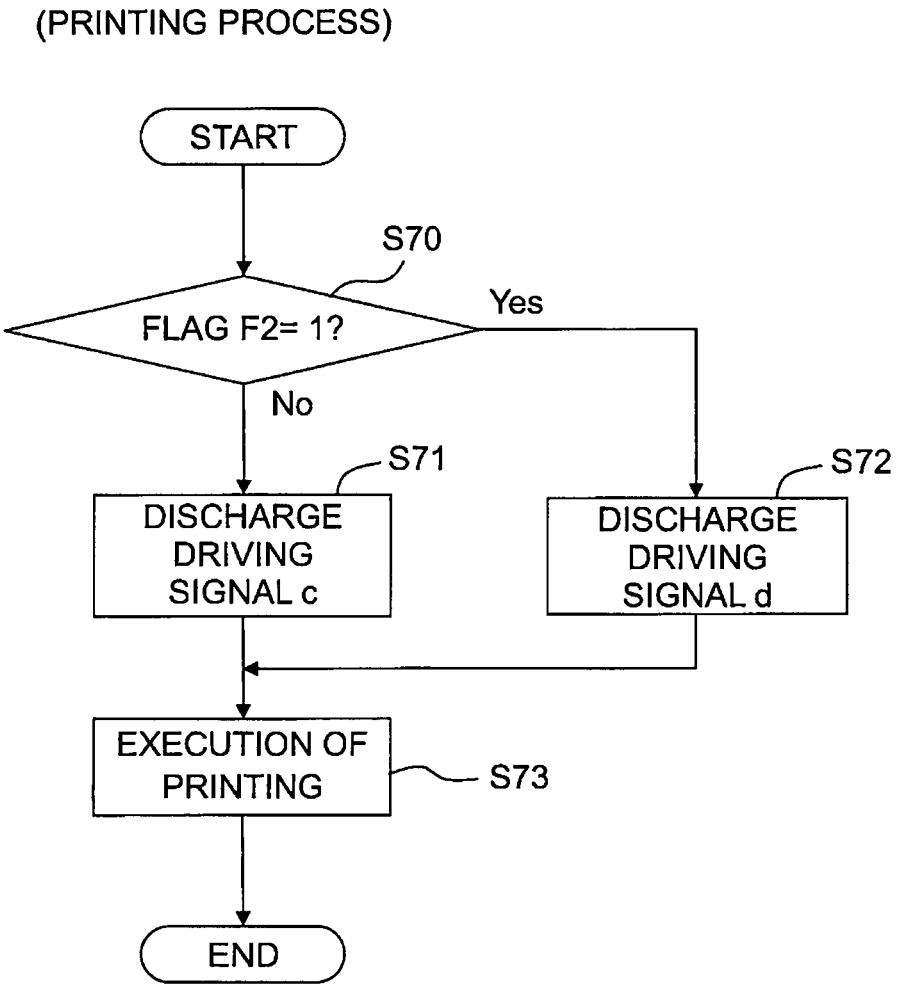
FIG. 16 is a flowchart of a printing process in which discharge driving signals depicted in FIG. 14 are used.

FIG. 15 is a flowchart indicating a part of the determining process (element deterioration judgment), in which the meniscus driving signal E of FIG. 14 is used, according to a modified embodiment. When the controller 8 has judged that the cause of discharge failure is neither thickening of ink nor mixing of bubbles through the steps S10 to S16 of FIGS. 10A and 10B, the controller 8 controls the driver IC 57 to apply the meniscus driving signal E depicted in FIG. 14 to the piezoelectric element 51, as shown in FIG. 15 (S60). The meniscus driving signal E has the rise time Ta and fall time Tb shorter than those of the meniscus driving signal A. When the light receiving amount received by the light receiving part 61 increases (S61: Yes), the controller 8 determines that the piezoelectric element 51 has deteriorated and leaves the nozzle 44 as it is (S62). Then, the controller 8 sets a flag F2, which indicates that the piezoelectric element 51 has deteriorated, to 1. When the light receiving amount received by the light receiving part 61 fails to increase despite the application of the meniscus driving signal E (S61: No), the controller 8 determines that the discharge failure has been caused by any other reason and thus selects the purge (S63).

One of the rise time Ta and fall time Tb of the meniscus driving signal E may be shorter than that of the meniscus driving signal A, and the other of the rise time Ta and fall time Tb may be the same as that of the meniscus driving signal A. The meniscus driving signal E corresponds to a sixth meniscus driving signal according to the present teaching.

When the controller 8 calculates that the piezoelectric element 51 has deteriorated as is the case with the above embodiment, it is preferred that the controller 8 shorten at least one of the rise time Ta and the fall time Tb of the discharge driving signal to be applied to the piezoelectric element 51 from the driver IC 57, at the time of printing on the recording sheet 100.

When the flag F2 is set to 0 in the determining process of FIG. 15, namely when the piezoelectric element 51 has no deterioration (S70: No), the controller 8 selects the meniscus driving signal c of FIG. 14 (S71). When the flag F1 is set to 1, namely when the piezoelectric element 51 has deterioration (S70: Yes), the controller 8 selects the discharge driving signal d of which rise time Ta and fall time Tb are shorter than those of the discharge driving signal c (S72). For example, the rise time Ta and fall time Tb of the discharge driving signal c may be each 4 μs, and the rise time Ta and fall time Tb of the discharge driving signal d may be each 2 μs. The controller 8 controls the driver IC 57 to apply the discharge driving signal selected for each piezoelectric element 51, so that the ink-jet head 4 performs printing (S73). Accordingly, the discharge driving signal d having the short rise time Ta and short fall time Tb can improve the discharge performance, of the nozzle 44, which has been lowered by the deterioration of the piezoelectric element 51.

Note that the rise time of the discharge driving signal x is represented as "Tax", in the following explanation. The rise time Tad (or fall time) of the discharge driving signal d can be determined as follows. Namely, when the rise time of the discharge driving signal c is Tac and the light receiving amount received by the light receiving part 61 in the case of applying the meniscus driving signal E is Ie, the controller 8 determines the rise time Tad of the discharge driving signal d to meet $Tad \leq Tac \times Ie/I0$ on the basis of the ratio of the light receiving amount Ie to the light receiving amount I0 which is the determination threshold of discharge failure ($Tac: Tad=1/Ie:1/10$).

In the above embodiment, the controller 8 calculates, in the determining process of FIGS. 10A and 10B, the cause of discharge failure in the following order: the thickening of ink, the mixing of bubbles, and the deterioration of the piezoelectric element 51 or the mixing of foreign substances. Then, the controller 8 selects the most suitable recovery operation for each of the causes. The present teaching, however, is not limited to this, and the controller 8 may calculate the cause of discharge failure in any other order to select the most suitable recovery operation. For example, the meniscus driving signal B may be at first applied to the piezoelectric element 51 to judge whether or not mixing of bubbles occurs. Further, in the determining process, it is not indispensable to perform all of the determining processes including the judgements of thickening of ink, mixing of bubbles, and deterioration of the piezoelectric element 51 or mixing of foreign substances. For example, from among all of the determining processes, only the process for judging the thickening of ink and the process for judging the mixing of bubbles may be performed.

In the above embodiment, the printer 1 at first performs the judging process of discharge failure (FIG. 9) for each nozzle 44 to be inspected. Then, the printer 1 performs the determining process (FIGS. 10A and 10B) only for each nozzle 44 having a small light receiving amount. The judging process of discharge failure, however, may not be performed for each nozzle 44 to be inspected, and the following manner is also allowable. Namely, a certain meniscus driving signal, which detects the cause of discharge failure, is at first applied to the piezoelectric element 51 without the judgment process of discharge failure. For example, the meniscus driving signal B having a large pulse width may be applied to the piezoelectric element 51 corresponding to the nozzle 44 to be inspected so that the judgment of mixing of bubbles and the judgement of need for purge are at first performed.

In the above embodiment, the recovery operation for each nozzle 44 of the ink-jet head 4 is performed after the inspection of discharge failure (including the determination of the recovery operation) is performed for each nozzle 44. However, the following manner is also allowable. Namely, when some nozzles 44, which have been subjected to the inspection of discharge failure, include a nozzle 44 having discharge failure, the recovery operation may be performed for the nozzle 44 having the discharge failure before the inspection of discharge failure for remaining nozzles 44 which are not yet inspected.

In the above embodiment, the light receiving part 61 detects the light which is emitted from the light-emitting part 60, is introduced into the nozzle 44, and is allowed to escape to the outside of the nozzle 44 after passing through the meniscus. The present teaching, however, can be applied to a light receiving part having any configuration other than the above.

Figure 17A:
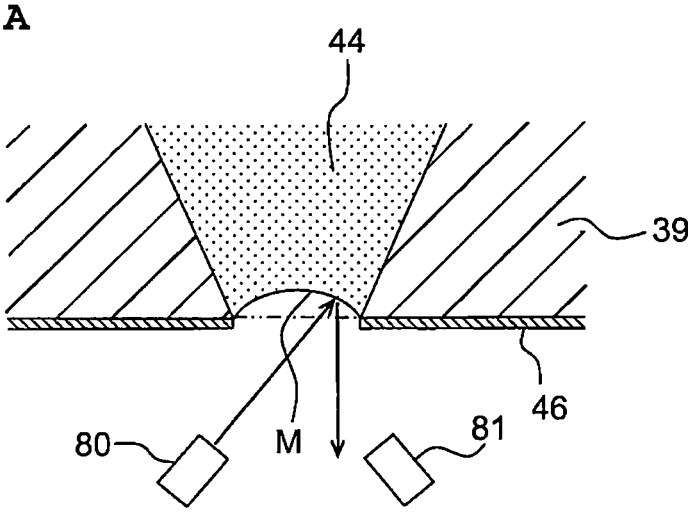
FIGS. 17A and 17B are cross-sectional views according to a modified embodiment which correspond to FIG. 8.
Figure 17B:
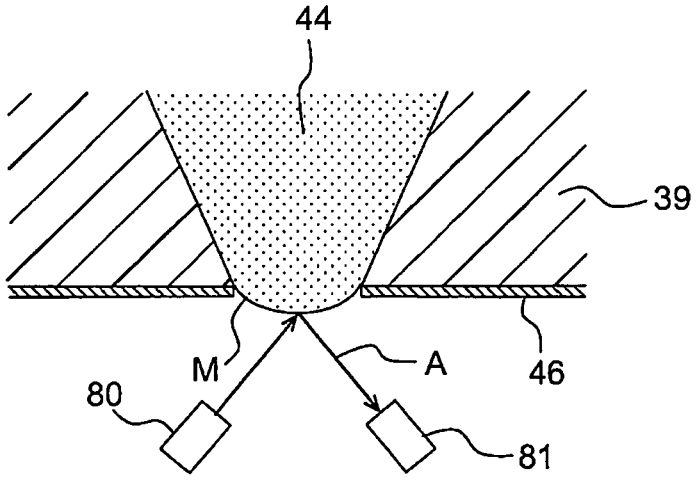

For example, as depicted in FIGS. 17A and 17B, a light emitting part 80 emits light from the outside of the nozzle 44 to a meniscus M of the nozzle 44. A light receiving part 81 is disposed to receive the light which travels in a direction A after being reflected by the meniscus M of the nozzle 44. As depicted in FIG. 17A, when the light emitted from the light emitting part 80 is reflected by the meniscus M drawn into the nozzle 44 to have a concave shape, most of the light reflected by the concave meniscus M travels in a direction different from the direction A. This reduces the light receiving amount received by the light receiving part 81. On the other hand, as depicted in FIG. 17B, when the light emitted from the light emitting part 80 is reflected by the meniscus M in a convex shape, most of the light reflected by the convex meniscus M travels in the direction A. This increases the light receiving amount received by the light receiving part 81. When the nozzle 44 has discharge failure, the degree of convex of the convex meniscus M is small. This reduces the amount of light travelling in the direction A, and thereby resulting in the reduction of the light receiving amount received by the light receiving part 81. The arrangement of the light emitting part 80 and the light receiving part 81 is not limited to that depicted in FIGS. 17A and 17B, and any other arrangement is allowable. However, the arrangement in which the light emitting part 80, the light receiving part 81, and the maintenance unit 7 are arranged on the right side of the platen 2 (see FIG. 1) is suitable for the case in which discharge failure is eliminated by the purge.

In the above embodiment, the driver IC 57 drives the piezoelectric element 51 in accordance with pull driving. In the pull driving, negative pressure wave is generated by increasing the volume of the pressure chamber 42, the vibration film 50 is pressed down to reduce the volume of the pressure chamber 42 at the timing at which the negative pressure wave is inverted, and thus pressure waves overlap with each other. The driving unit 57, however, may drive the piezoelectric element 51 in accordance with push driving. In the push driving, the volume of the pressure chamber 42 in a standby state is simply reduced to generate positive pressure wave, and thus ink is discharged. In the push driving, the voltage of the driving signal is changed from a low voltage to a high voltage and again to a low voltage. In this case, this change of the voltage signal (the low voltage→the high voltage→the low voltage) is referred to as a pulse signal. The pulse width means a time period of the high voltage, and the pulse height means a voltage difference between the low voltage and the high voltage.

In the above embodiment, the piezoelectric elements are used as the driving elements which discharge ink from the nozzles. The present teaching, however, can be applied to a configuration in which driving elements other than the piezoelectric elements are adopted. For example, the present teaching can be applied to an apparatus including, as the driving elements, heating elements which apply heat energy to ink, wherein the ink is discharged from the nozzles by means of the film boiling of ink.

The maintenance unit which performs the purge for nozzles is not limited to the maintenance unit performing the suction purge using the cap according to the above embodiment. Namely, the maintenance unit may be a maintenance unit including a pressure pump which applies pressure to ink from the ink supply side of the ink-jet head, wherein the ink is forcibly discharged from each of the nozzles by means of the pressure pump.

In the embodiment and the modified embodiments as described above, the present teaching is applied to an ink-jet printer which discharges ink on a recording sheet to print an image etc. The present teaching, however, can be also applied to a liquid jetting apparatus used in various uses other than the printing of the image etc. For example, the present teaching can be also applied to an industrial liquid jetting apparatus which discharges a conductive liquid on a board to form a conductive pattern on the surface of the board.

What is claimed is:

1. A liquid discharge apparatus configured to discharge liquid to a medium, comprising:

a liquid discharge head including a channel structure, a driving element, and a driving unit, the channel structure including a nozzle and a liquid channel communicating with the nozzle, the driving element provided in the channel structure and configured to supply, to the liquid, discharge energy for discharging the liquid from the nozzle, and the driving unit configured to apply a discharge driving signal and several kinds of meniscus driving signals to the driving element, the discharge driving signal being applied to discharge the liquid from the nozzle corresponding to the driving element, the meniscus driving signals having mutually different waveforms and being applied to vibrate meniscus of the liquid in a discharge port of the nozzle corresponding to the driving element;

a light emitting part configured to emit light to the nozzle of the liquid discharge head;

a light receiving part configured to receive light which has passed through the meniscus of the nozzle or been reflected by the meniscus; and a controller configured to:

control the driving unit to apply at least one of the meniscus driving signals to the driving element in a state that the light emitting part emits the light to the nozzle corresponding to the driving element, thereby vibrating the meniscus of the liquid in the discharge port of the nozzle; and determine an operation from among a no recovery operation and several kinds of recovery operations which have mutually different liquid discharge amounts to be discharged from the nozzle, based on an amount of light which is received by the light receiving part in a case of vibrating the meniscus of the liquid, wherein in a case of determining the operation from among the no recovery operation and the recovery operations, the controller is configured to control the driving unit to apply an additional meniscus driving signal.

2. The liquid discharge apparatus according to claim 1, wherein, in a case that the meniscus of the liquid in the nozzle is vibrated to become convex to an outside of the nozzle, an amount of light which travels in a particular direction after passing through the meniscus or an amount of light which travels in the particular direction after being reflected by the meniscus increases;

the light receiving part is disposed to receive the light traveling in the particular direction; and the controller is configured to:

control the driving unit to apply a first meniscus driving signal of the meniscus driving signals to the driving element in the state that the light emitting part emits the light to the nozzle corresponding to the driving element, thereby vibrating the meniscus of the liquid in the discharge port of the nozzle; and determine a recovery operation from among the recovery operations which have the mutually different liquid discharge amounts to be discharged from the nozzle, in a case that a light receiving amount, which has been received by the light receiving part in the case of applying the first meniscus driving signal to the driving element, is not more than a particular value, on the basis of a light receiving amount which is received by the light receiving part in a case of vibrating the meniscus with a meniscus driving signal, of the meniscus driving signals, except for the first meniscus driving signal.

3. The liquid discharge apparatus according to claim 2, wherein, in the case of determining the operation from among the no recovery operation and the recovery operations, the controller is configured to:

control the driving unit to apply a second meniscus driving signal of the meniscus driving signals to the driving element, in the case that the light receiving amount, which has been received by the light receiving part in the case of applying the first meniscus driving signal to the driving element, is not more than the particular value; and select a first recovery operation which has a smallest liquid discharge amount in the recovery operations, in a case that a light receiving amount, which has been received by the light receiving part in the case of applying the second meniscus driving signal to the driving element, exceeds the particular value.

4. The liquid discharge apparatus according to claim 3, wherein, in the case of determining the operation from among the no recovery operation and the recovery operations, the controller is configured to select a second recovery operation which has a liquid discharge amount larger than that of the first recovery operation, in a case that the light receiving amount, which has been received by the light receiving part in the case of applying the second meniscus driving signal to the driving element, is not more than the particular value but exceeds the light receiving amount obtained in the case of applying the first meniscus driving signal.

5. The liquid discharge apparatus according to claim 3, wherein, in the case of determining the operation from among the no recovery operation and the recovery operations, the controller is configured to:

control the driving unit to apply the second meniscus driving signal to the driving element multiple times, thereby vibrating the meniscus multiple times; and select a second recovery operation which has a liquid discharge amount larger than that of the first recovery operation, in a case that a light receiving amount, which has been received by the light receiving part in the case of applying the second meniscus driving signal to the driving element multiple times, is not more than the particular value but increases with the multiple times of the applying the second meniscus driving signal.

6. The liquid discharge apparatus according to claim 2, further comprising a maintenance unit configured to perform a third recovery operation, in which the liquid is discharged from the discharge port of the nozzle, independently of the discharge of the liquid from the nozzle caused by the driving element driven by the driving unit, wherein the recovery operations include the third recovery operation performed by the maintenance unit;

the channel structure includes a pressure chamber communicating with the nozzle and a vibration film disposed to cover the pressure chamber;

the driving element is a piezoelectric element, which is disposed to correspond to the pressure chamber and is configured to apply pressure to the liquid in the pressure chamber by deformation of the vibration film;

each of the meniscus driving signals to be applied to the piezoelectric element by the driving unit is a pulse signal; and in the case of determining the operation from among the no recovery operation and the recovery operations, the controller is configured to:

control the driving unit to apply a third meniscus driving signal to the piezoelectric element, the third meniscus driving signal being included in the meniscus driving signals and having a pulse width larger than that of the first meniscus driving signal; and select the third recovery operation in a case that a light receiving amount, which has been received by the light receiving part in the case of applying the third meniscus driving signal to the piezoelectric element, is greater than the light receiving amount which has been received by the light receiving part in the case of applying the first meniscus driving signal.

7. The liquid discharge apparatus according to claim 6, wherein the pulse width of the third meniscus driving signal is 1.1 to 1.5 times greater than the pulse width of the first meniscus driving signal.

8. The liquid discharge apparatus according to claim 6, wherein the controller is configured to:

control the driving unit to apply a fourth meniscus driving signal, which has a pulse width larger than that of the third meniscus driving signal, to the piezoelectric element, in the case that the light receiving amount, which has been received by the light receiving part in the case of applying the third meniscus driving signal to the piezoelectric element, is greater than the light receiving amount which has been received by the light receiving part in the case of applying the first meniscus driving signal; and select the third recovery operation, in a case that a light receiving amount, which has been received by the light receiving part in the case of applying the fourth meniscus driving signal to the piezoelectric element, is greater than the light receiving amount in the case of applying the third meniscus driving signal.

9. The liquid discharge apparatus according to claim 6, wherein the controller is configured to:

control the driving unit to apply a fourth meniscus driving signal, which has a pulse width larger than that of the third meniscus driving signal, to the piezoelectric element, in the case that the light receiving amount, which has been received by the light receiving part in the case of applying the third meniscus driving signal to the piezoelectric element, is greater than the light receiving amount, which has been received by the light receiving part in the case of applying the first meniscus driving signal; and select the no recovery operation to leave the nozzle as it is, in a case that a light receiving amount, which has been received by the light receiving part in the case of applying the fourth meniscus driving signal to the piezoelectric element, fails to increase compared to the light receiving amount in the case of applying the third meniscus driving signal.

10. The liquid discharge apparatus according to claim 2, wherein, in the case of determining the operation from among the no recovery operation and the recovery operations, the controller is configured to:

control the driving unit to apply a fifth meniscus driving signal, which has a peak value greater than that of the first meniscus driving signal, to the driving element; and determine a recovery operation from among the recovery operations, in a case that a light receiving amount, which has been received by the light receiving part in the case of applying the fifth meniscus driving signal to the driving element, fails to increase compared to the light receiving amount in the case of applying the first meniscus driving signal.

11. The liquid discharge apparatus according to claim 2, wherein, in the case of determining the operation from among the no recovery operation and the recovery operations, the controller is configured to:

control the driving unit to apply a fifth meniscus driving signal, which has a peak value greater than that of the first meniscus driving signal, to the driving element; and select the no recovery operation to leave the nozzle as it is, in a case that a light receiving amount, which has been received by the light receiving part in the case of applying the fifth meniscus driving signal to the driving element, is greater than the light receiving amount in the case of applying the first meniscus driving signal.

12. The liquid discharge apparatus according to claim 11, wherein the peak value of the fifth meniscus driving signal is 1.1 times greater than the peak value of the first meniscus driving signal and is smaller than a peak value of the discharge driving signal.

13. The liquid discharge apparatus according to claim 10, wherein, in the case of determining the operation from among the no recovery operation and the recovery operations, the controller is configured to:

raise a peak value of the discharge driving signal, in the case that the light receiving amount, which has been received by the light receiving part in the case of applying the fifth meniscus driving signal to the driving element, is greater than the light receiving amount in the case of applying the first meniscus driving signal.

14. The liquid discharge apparatus according to claim 2, wherein each of the meniscus driving signals is a pulse signal; and in the case of determining the operation from among the no recovery operation and the recovery operations, the controller is configured to:

control the driving unit to apply, to the driving element, a sixth meniscus driving signal in which one of a rise time and a fall time of a pulse waveform is shorter than that of the first meniscus driving signal and the other one of the rise time and the fall time is identical to or shorter than that of the first meniscus driving signal; and determine a recovery operation from among the recovery operations, in a case that a light receiving amount, which has been received by the light receiving part in the case of applying the sixth meniscus driving signal to the driving element, fails to increase compared to the light receiving amount in the case of applying the first meniscus driving signal.

15. The liquid discharge apparatus according to claim 14, wherein the controller is configured to shorten at least one of the rise time and the fall time of the pulse waveform of the discharge driving signal, in a case that the light receiving amount, which has been received by the light receiving part in the case of applying the sixth meniscus driving signal to the driving element, is greater than the light receiving amount in the case of applying the first meniscus driving signal.

16. A liquid discharge apparatus configured to discharge liquid to a medium, comprising:

a liquid discharge head including a channel structure, the channel structure including a nozzle and a liquid channel communicating with the nozzle, a driving element, the driving element provided in the channel structure and configured to supply, to the liquid, discharge energy for discharging the liquid from the nozzle, and a driving unit, the driving unit configured to apply a discharge driving signal and several kinds of meniscus driving signals to the driving element, the discharge driving signal being applied to discharge the liquid from the nozzle corresponding to the driving element, the meniscus driving signals having mutually different waveforms and being applied to vibrate meniscus of the liquid in a discharge port of the nozzle corresponding to the driving element;

a light emitting part configured to emit light to the nozzle of the liquid discharge head;

a light receiving part configured to receive light which has passed through the meniscus of the nozzle or been reflected by the meniscus; and a controller configured to:

control the driving unit to apply the meniscus driving signals to the driving element in a state that the light emitting part emits the light to the nozzle corresponding to the driving element, thereby vibrating the meniscus of the liquid in the discharge port of the nozzle; and determine an operation from among a no recovery operation and several kinds of recovery operations which have mutually different liquid discharge amounts to be discharged from the nozzle, based on an amount of light which is received by the light receiving part in a case of vibrating the meniscus of the liquid, wherein the meniscus driving signals correspond to the several kinds of recovery operations, respectively.

* * * * *